US008656843B2

(12) United States Patent
Monteith

(10) Patent No.: US 8,656,843 B2
(45) Date of Patent: Feb. 25, 2014

(54) PALLETS RAILS AND METHODS FOR MAKING SAME

(75) Inventor: David Wesley Monteith, Charlotte, NC (US)

(73) Assignee: Conitex-Sonoco, LLC, Gastonia, NC (US)

( * ) Notice: Subject to any disclaimer, the term of this patent is extended or adjusted under 35 U.S.C. 154(b) by 0 days.

(21) Appl. No.: 13/584,920

(22) Filed: Aug. 14, 2012

(65) Prior Publication Data

US 2012/0312200 A1 Dec. 13, 2012

Related U.S. Application Data

(63) Continuation-in-part of application No. 12/468,172, filed on May 19, 2009, now abandoned, which is a continuation-in-part of application No. 11/625,543, filed on Jan. 22, 2007, now abandoned.

(60) Provisional application No. 60/747,626, filed on May 18, 2006.

(51) Int. Cl.
*B65D 19/00* (2006.01)

(52) U.S. Cl.
USPC ... 108/51.3; 108/56.1; 108/57.22; 108/57.29; 108/57.31

(58) Field of Classification Search
USPC ..... 108/51.3, 56.3, 51.11, 57.31, 52.1, 108/56.1, 57.1, 57.17, 57.18, 57.22, 57.23, 108/57.29
See application file for complete search history.

(56) References Cited

U.S. PATENT DOCUMENTS

| | | | | | |
|---|---|---|---|---|---|
| 2,996,276 | A * | 8/1961 | Thor et al. | 108/51.3 |
| 3,589,309 | A * | 6/1971 | Clark, Jr. | 108/55.5 |
| 3,881,429 | A * | 5/1975 | Seymore | 108/51.3 |
| 4,966,084 | A * | 10/1990 | Motomaru | 108/51.3 |
| 5,176,090 | A * | 1/1993 | Roberts et al. | 108/51.3 |
| 5,370,062 | A * | 12/1994 | Johnston et al. | 108/51.3 |
| 5,408,937 | A * | 4/1995 | Knight et al. | 108/55.5 |
| 5,603,266 | A * | 2/1997 | Nash | 108/56.3 |
| 5,660,119 | A * | 8/1997 | Perkins | 108/51.3 |
| 5,799,584 | A * | 9/1998 | Campbell | 108/51.3 |
| 6,041,719 | A * | 3/2000 | Vidal et al. | 108/51.3 |
| 6,135,030 | A * | 10/2000 | Besaw | 108/51.3 |
| 6,357,364 | B1 * | 3/2002 | Maloney et al. | 108/51.3 |
| 2002/0185580 | A1 * | 12/2002 | Giasi | 248/346.4 |
| 2005/0092214 | A1 * | 5/2005 | Edell | 108/51.3 |
| 2006/0236899 | A1 * | 10/2006 | Nelson | 108/51.3 |
| 2006/0288913 | A1 * | 12/2006 | Lo | 108/51.3 |
| 2009/0223421 | A1 * | 9/2009 | Ferguson | 108/51.3 |
| 2009/0308289 | A1 * | 12/2009 | Ferguson | 108/51.3 |
| 2010/0011999 | A1 * | 1/2010 | Harp et al. | 108/51.3 |

* cited by examiner

*Primary Examiner* — Daniel Rohrhoff
(74) *Attorney, Agent, or Firm* — Shumaker, Loop & Kendrick, LLP

(57) ABSTRACT

A pallet rail includes an elongate support box and a plurality of separately formed reinforcing tubes. The support box is formed from a paper blank that is folded along parallel fold lines. The reinforcing tubes are positioned within the support box to reinforce the box. Two side walls have arcuate corners to define two opposing longitudinal ends of the support box having curved lower profiles. Another pallet rail includes an elongate support box, an adjacent end wall, and a plurality of separately-formed reinforcing tubes.

5 Claims, 36 Drawing Sheets

PALLETS RAILS AND METHODS FOR MAKING SAME

CROSS-REFERENCE TO RELATED APPLICATIONS

This application is a Continuation-in-Part (CIP) application of and claims the benefit of priority of pending U.S. patent application Ser. No. 12/468,172, previously filed on May 19, 2009, and entitled "Pallet and Methods for Making Same." The Ser. No. 12/468,172 application is a Continuation-in-Part (CIP) application of, and claims the benefit of priority of U.S. patent application Ser. No. 11/625,543, previously filed on Jan. 22, 2007, and entitled "Pallet and Methods for Making Same." This present CIP application, the Ser. No. 12/468,172 CIP application, and the previously filed Ser. No. 11/625,543 application claim the benefit of priority of U.S. Provisional Application No. 60/747,626, filed May 18, 2006. The contents of each of the Ser. Nos. 12/468,172, 11/625,543, and the 60/747,626 applications are hereby incorporated herein by this reference.

TECHNICAL FIELD AND BACKGROUND OF THE INVENTION

The invention relates generally to pallets for supporting objects and methods for making same, and more particularly to a pallet rail having arcuate corners to minimize jamming of the pallet rail as it is moved and a pallet rail having an upwardly projecting end wall for aligning the pallet rail along the side of a palletized load.

Pallets and pallet components constructed of paper material such as corrugated cardboard are suitable for supporting and transporting many products. Typical cardboard constructions cost less to manufacture and weigh less than wooden pallets. Though typical wood pallets do exhibit higher strength and durability than typical cardboard pallets, wood pallets are typically returned to a shipment supplier for reuse or broken down and discarded and thus their use includes costs that occur after their first use in delivering cargo.

Wood pallets occupy space wherever they are collected and are generally formed as one-piece constructions having rails and slats or large-area loading surfaces. They are not conveniently reduced to smaller sizes or easily disassembled for shipment and storage. A wood pallet typically represents the first use of wood, a valuable natural resource, whereas cardboard can be formed from recycled material.

Cardboard pallets are in use in industries and developments are occurring to increase their applicability, strength, and convenience.

SUMMARY OF THE INVENTION

Accordingly, there is a need for improved pallets and pallet rails. Therefore it is an object of the present invention to provide several embodiments of a pallet rail, two or more of which are usable in spaced-apart relation to support respective portions of a rigid load to thereby form a pallet. In a first embodiment, the pallet rail includes an elongate support box, and a plurality of separately formed reinforcing tubes. The support box is formed from a paper blank that is folded along three parallel fold lines to define two laterally spaced-apart side walls, a bottom wall, and a vertically spaced-apart upper support wall for supporting a portion of the rigid load. The reinforcing tubes are positioned within the support box in spaced-apart relation along the length of the box between the bottom wall and upper support wall to reinforce the box and define the distance of the upper support wall above the bottom wall. The two side walls have arcuate corners adjacent the bottom wall to define two opposing longitudinal ends of the support box having curved lower profiles. The paper blank may also be folded along a fourth fold line that is parallel to the three parallel fold lines to define a second bottom wall overlapping the bottom wall.

In at least one example according to the first embodiment, the upper support wall has two longitudinal ends each having a central alignment notch for aligning the pallet rail under corresponding alignment notches of the rigid load. The two opposing longitudinal ends of the support box may also have notches formed for receiving and holding a wrapping material for wrapping the pallet rail and rigid load. The paper blank may be formed of corrugated paper, and the reinforcing tubes may be formed of densified paper.

In a second embodiment, the pallet rail includes an elongate support box, an adjacent end wall, and a plurality of separately-formed reinforcing tubes. The support box is formed from a paper blank that is folded along three parallel fold lines to define an inner wall, a laterally spaced-apart outer wall, a bottom wall and a vertically spaced-apart upper support wall for supporting one end of the rigid load. The adjacent end wall projects upwardly from the outer wall for engaging one end of the rigid load. The reinforcing tubes are positioned within the support box in spaced-apart relation along the length of the box between the bottom wall and upper support wall to reinforce the box and define the distance of the upper support wall above the bottom wall. There are at least two openings in the inner wall and at least two openings in the outer wall aligned with the at least two openings in the inner wall for receiving the forks of a forklift used to move the pallet.

In at least one example according to the second embodiment, an adhesive strip is positioned along the upper support wall for adhering the pallet rail to the rigid load. The pallet rail may also include longitudinally spaced-apart lateral walls extending between the openings in the inner wall and the openings in the outer wall for facing the forks of the forklift used to move the pallet. The paper blank may be formed of corrugated paper, and the reinforcing tubes may be formed of densified paper.

In a third embodiment, the pallet rail includes an elongate support box and at least one elongate reinforcing tube. The support box is formed from a paper blank that is folded along three parallel fold lines to define two laterally spaced-apart side walls, a bottom wall, and a vertically spaced-apart upper support wall for supporting a portion of the rigid load. The reinforcing tube is positioned longitudinally within the support box between the bottom wall and upper support wall to reinforce the box. The tube has a diameter that defines the distance of the upper support wall above the bottom wall.

In at least one example according to the third embodiment, the pallet rail also includes two separately-formed reinforcing tubes positioned within the support box at opposing longitudinal ends of the elongate reinforcing tube and between the bottom wall and upper support wall to reinforce the box and define the distance of the support wall above the bottom wall. The paper blank may also be folded along a fourth fold line that is parallel to the three parallel fold lines to define a second upper support wall overlapping the upper support wall.

It is also an object of the present invention to provide a method of making a pallet rail, two or more of which are usable in spaced-apart relation to support respective portions of a rigid load to thereby form a pallet. In at least one embodiment, the method includes forming a blank into a square tube having a square cross section with four sides each having substantially the same width within the square tube, and positioning a round tube having a diameter substantially the same as the width of the four sides into the square tube to reinforce the square tube. The round tube may be positioned into the square tube by inserting the round tube into a longitudinal end of the square tube, or by hinging at least one of the four sides to open the square tube and passing the round tube laterally into the open square tube.

It is also an object of the present invention to provide a pallet rail, two or more of which are usable in spaced-apart relation to support respective portions of a rigid load to thereby form a four-way pallet. This four-way pallet has an elongate support box formed from a paper blank that is folded along four parallel fold lines to define a pair of laterally spaced-apart side walls, a bottom wall, a second bottom wall overlapping the bottom wall, and a vertically spaced-apart upper support wall. It also has a pair of tab-less, rectangular openings disposed on each one of the pair of side walls, having a height that is equal to the height of the side wall and a width of sufficient size for a fork of a fork lift to enter. These openings are die cut such that they are smooth with no residual material. The openings thus span the width of the side wall allowing maximum opening height for the side entry of a forklift. The openings do not include any type of flap or tab extending outward or inward but instead provide a clean opening in the side of the rail. This tab-less aspect is important so as to facilitate the use of a forklift as well as simplified construction. The die cut opening is also important as it relates to the pallet being constructed from paper. The clean opening is less likely to be deformed or torn from use of a forklift.

The pallet has a pair of central alignment notches, visible from a front, a rear, a top, or a bottom view, for aligning the pallet rail under corresponding alignment notches of the rigid load, wherein one of the pair of central alignment notches is disposed on a longitudinal end of the upper support wall and the other of the pair of central alignment notches is disposed on an opposite longitudinal end of the upper support wall. The pallet also utilizes a set of three or four separately-formed reinforcing tubes positioned within each support box in spaced apart relation along a length of the box between the bottom wall and the upper support wall to reinforce the box and define the distance of the upper support wall above the bottom wall, wherein each of the tubes is cylindrical around an axis that is perpendicular to the upper support wall and the bottom wall and is parallel to the side walls.

It is also an object of the present invention to provide a pallet rail using three or four separately-formed reinforcing tubes positioned within the support box where the pallet rail is reversible such that the rigid load can be applied to the upper support wall or to the bottom wall. Thus, the pallet can be flipped upside down and function just as well.

It is also an object of the present invention to provide a pallet rail using three or four separately-formed reinforcing tubes positioned within the support box where the pallet rail utilizes an adhesive strip positioned along the upper support wall for adhering the pallet rail to the rigid load.

It is also an object of the present invention to provide a pallet rail using three or four separately-formed reinforcing tubes positioned within the support box where the pallet rail has a set of four notches formed for receiving and holding a wrapping material for wrapping the pallet rail and the rigid load, the use of four reinforcing tubes being preferred and optimal where the pallet is required to carry especially heavy rigid loads.

It is also an object of the present invention to provide a pallet wherein the rigid load is applied to the rails via two sheets of paper. The sheets are stacked, one on the other, and are attached to each other with ethylene vinyl acetate. The two sheets are then attached to the rails.

According to another embodiment of the invention, a pallet rail has an elongate support box formed from a paper blank that is folded along four parallel fold lines to define a pair of laterally spaced-apart side walls, a bottom wall, a second bottom wall overlapping the bottom wall, and a vertically spaced-apart upper support wall. The pallet rail has a pair of die cut, tab-less, rectangular openings disposed on each one of the pair of side walls, having a height that is equal to the height of the side wall and a width of sufficient size for a fork of a fork lift to enter. The pallet rail has a first and a second central alignment notch, at least one of the notches visible from a front, or rear view, for aligning the pallet rail under corresponding alignment notches of the rigid load, wherein the first central alignment notch is disposed on a longitudinal end of the upper support wall and the second central alignment notch is disposed on an opposite longitudinal end of the upper support wall. This pallet rail also includes a set of no more than four separately-formed reinforcing tubes positioned within the support box, being cylindrical around an axis that is perpendicular to the upper support wall. The set of tubes includes a first end tube positioned midway between a plane formed by the outer edges of two of the die cut, tab-less rectangular openings disposed on opposite side walls and the plane formed by the outer edges of the end of the support box. The set of tubes includes a second end tube positioned midway between a plane formed by the outer edges of the other two of the tab-less openings disposed on opposite side walls and the plane formed by the outer edges of the other end of the support box. The set of tubes also includes one or two central tubes positioned between the plane formed by the inner edges of the two tab-less openings disposed on opposite side walls and plane formed by the inner edges of the other of the two tab-less openings disposed on opposite side walls.

BRIEF DESCRIPTION OF THE DRAWINGS

Some of the objects of the invention have been set forth above. Other objects and advantages of the invention will appear as the invention proceeds when taken in conjunction with the following drawings, in which.

DETAILED DESCRIPTIONS

Figure 1:
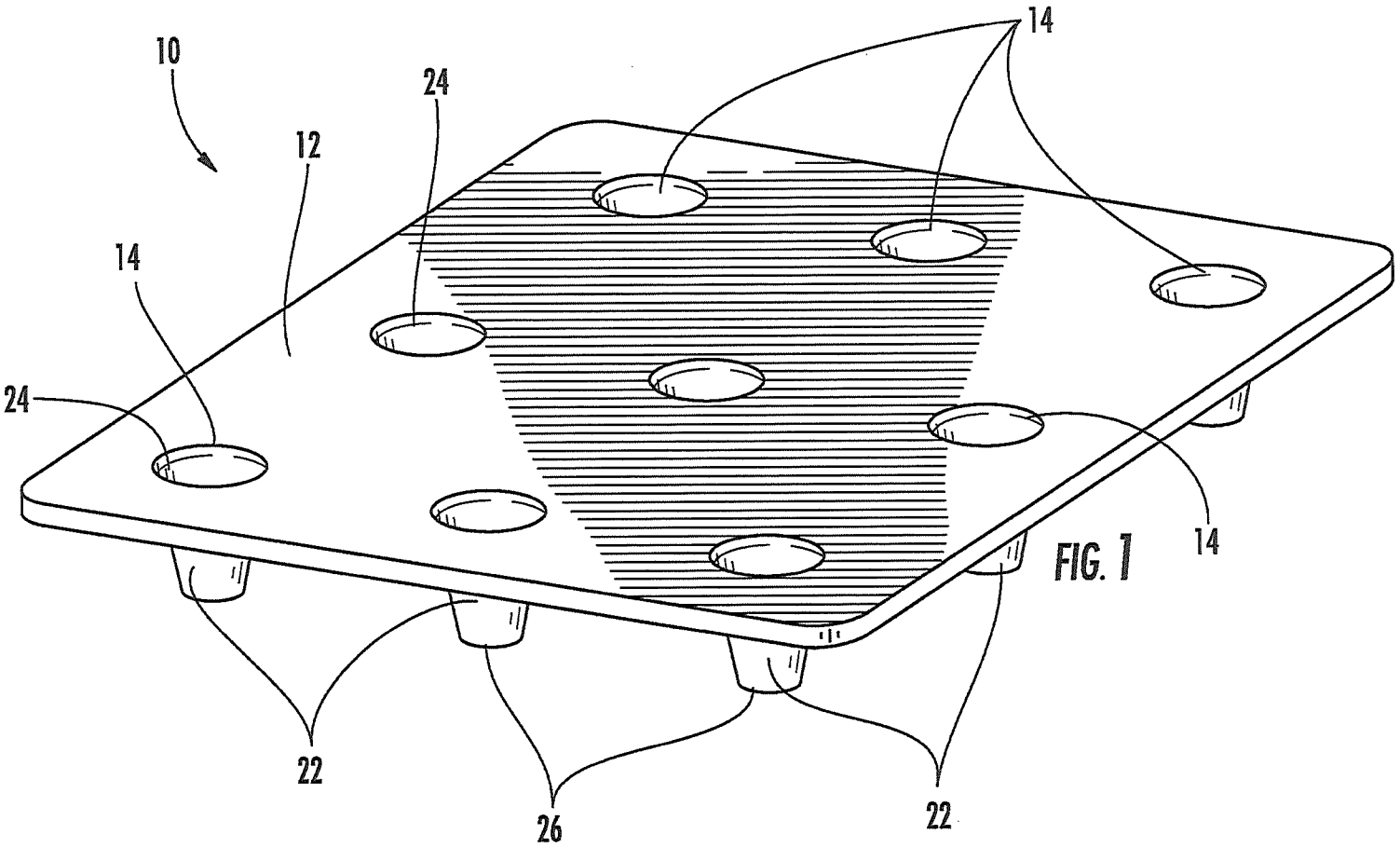
FIG. 1 is a perspective view of a pallet according to an embodiment of the invention.
Figure 2:
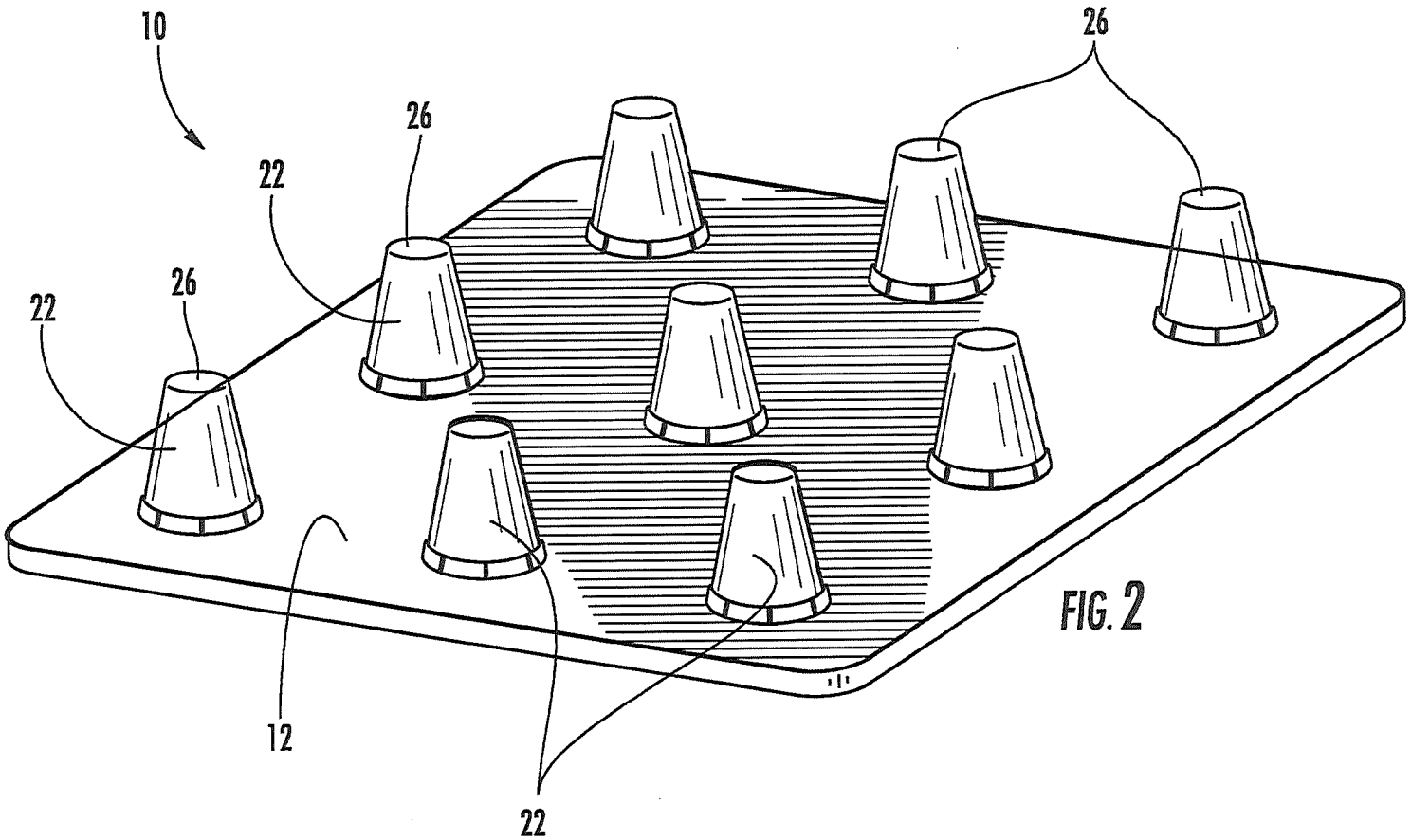
FIG. 2 is another perspective view of the pallet of FIG. 1.

Referring to the drawings wherein identical reference numerals denote the same elements throughout the various views, a pallet according to an embodiment of the invention is illustrated in FIGS. 1-4, and shown generally at reference numeral 10. The pallet 10 includes a platform 12 with a plurality of circular openings 14 and a leg 22 positioned within each of the openings 14. The legs 22 are preferably conical and positioned such that the larger diameter end 24 of each leg 22 is connected to the platform 12, and the smaller diameter end 26 rests on the floor.

The platform 12 is formed of double wall corrugated paper having a thickness of 6.5 mm, with nine openings 14 for receiving the legs 22. Each opening 14 has a diameter of 95 mm.

Figure 3:
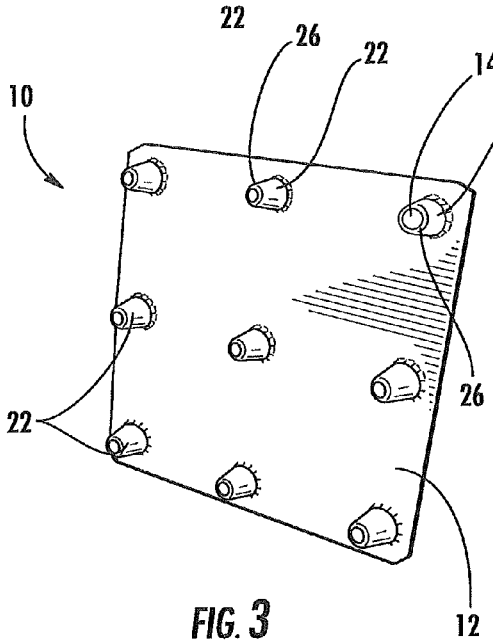
FIG. 3 is yet another perspective view of the pallet of FIG. 1.
Figure 4:
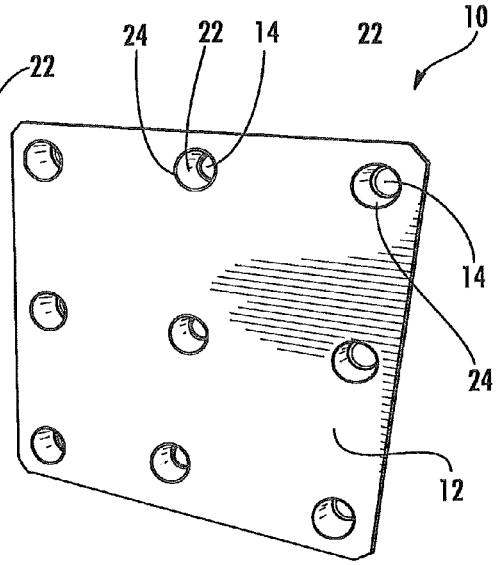
FIG. 4 is yet another perspective view of the pallet of FIG. 1.

As shown in FIGS. 3 and 4, the legs 22 are conical and open at both ends 24, 26, and are tapered at an angle of about 10 degrees. The legs 22 are made of 3-3.5 laps of 380-400 g/sqm paper having a thickness of 630 microns, and have a length of 116 mm. The inner diameter of the large diameter end 24 is 100 mm, and the inner diameter of the small diameter end 26 is 59 mm. The large diameter end 24 has a radius pattern 294, and the small diameter end 26 has a radius pattern of 177. Each leg 22 preferably weighs 40.7 grams. The pallet 10 is thus conducive to recycling and disposal as it can be made completely of paper.

Figure 5:
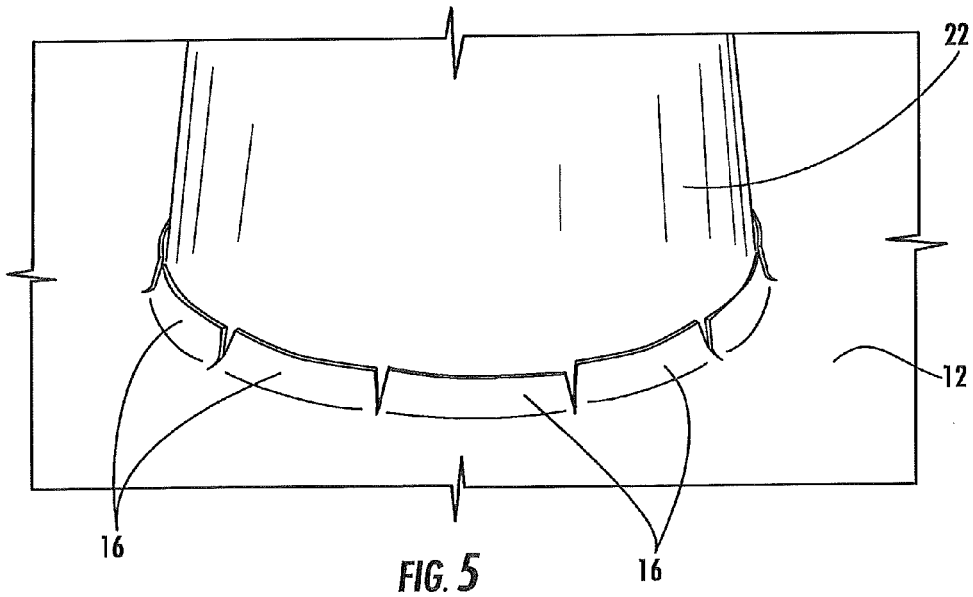
FIG. 5 is partial perspective view of the pallet of FIG. 1.

An adhesive, such as ethylene vinyl acetate (EVA) glue is sprayed or spread around the outer rim of the large diameter end 24 of the legs 22. The legs 22 are then pushed down through the openings 14. As shown in FIG. 5, the platform 12 includes foldable flap sections 16 proximate the openings 14. The openings 14 are sized such that the flap sections 16 fold downwardly and engage the large diameter end 24 of the legs 22 when the legs 22 are pushed through the openings 14. The adhesive on the legs 22 adheres to the flap sections 16 of the platform 12. Alternatively, the adhesive can be put on the flap sections 16 prior to positioning the legs 22 within the openings 14.

Figure 6:
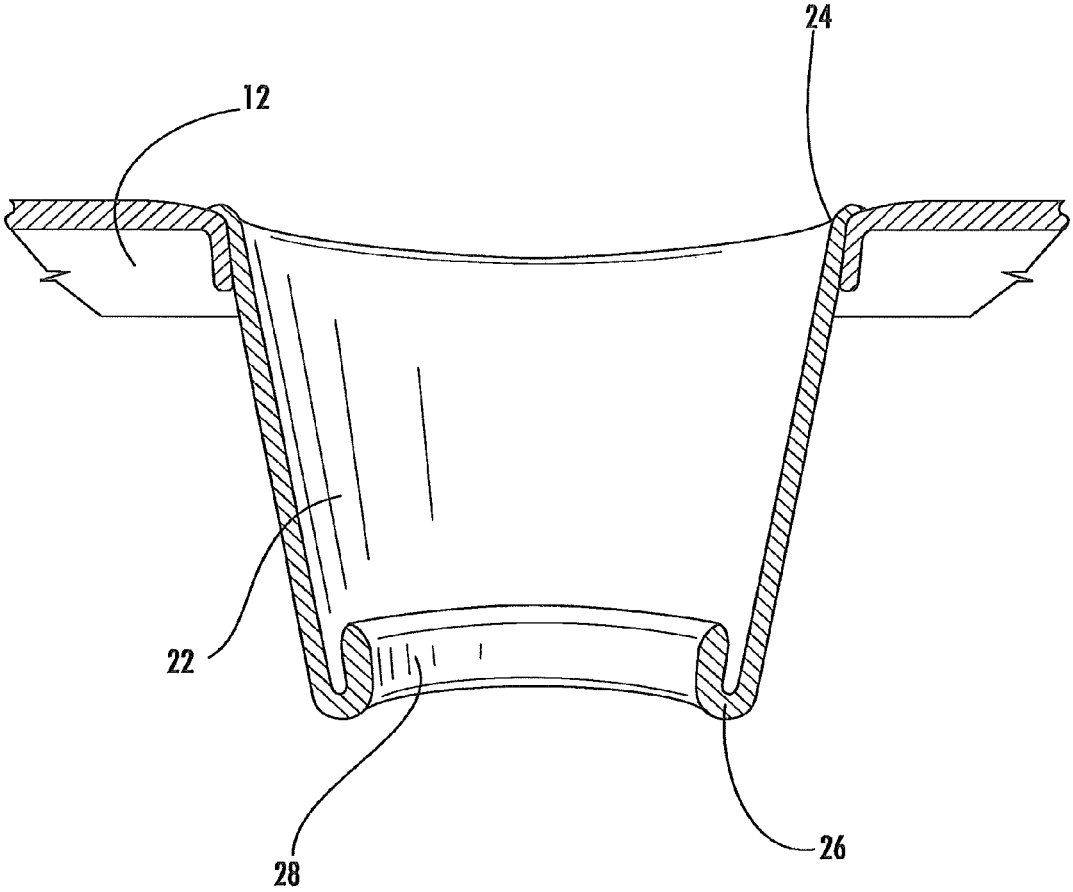
FIG. 6 is a partial cross sectional view of the pallet of FIG. 1.
Figure 7:
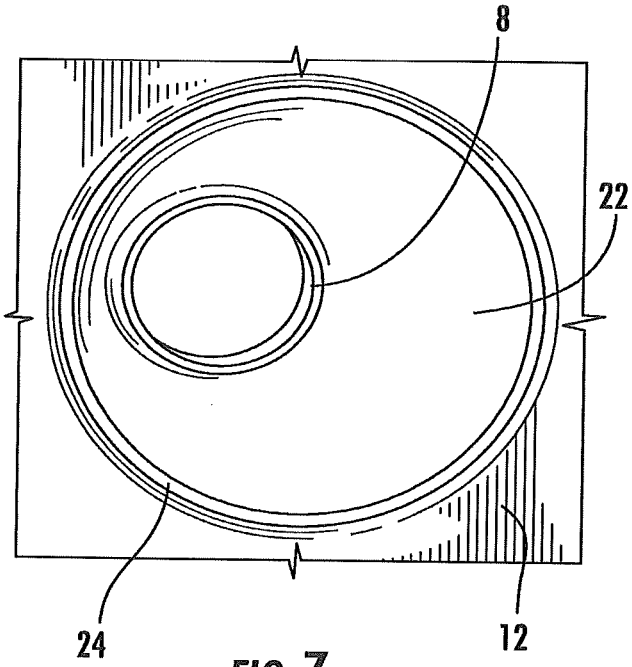
FIG. 7 is a partial perspective view of the pallet of FIG. 1.

As shown in FIGS. 6 and 7, each leg 22 has a bull nose 28 formed at the small diameter end 26. The bull nose 28 is formed by folding a portion of the leg 22 inwardly so that the bull nose 28 extends around the circumference of the inner wall surface of the leg 22.

Figure 8:
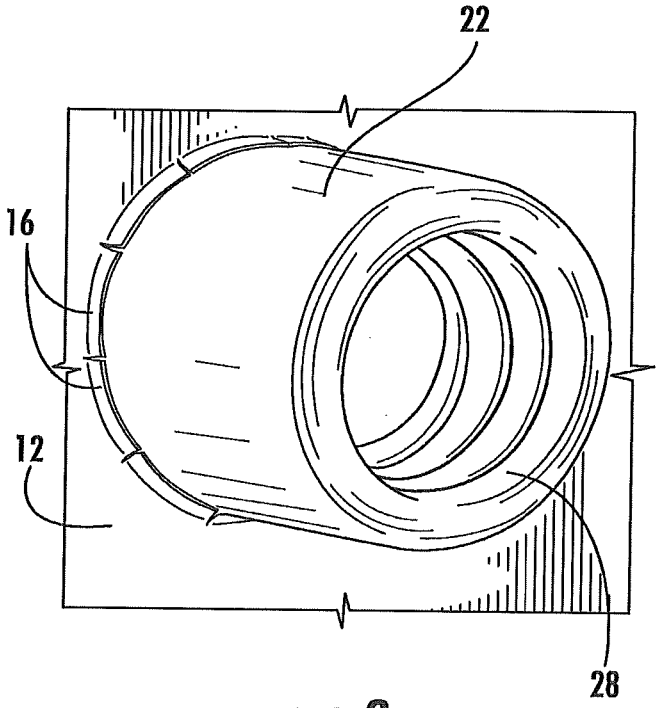
FIG. 8 is another partial perspective view of the pallet of FIG. 1.
Figure 9:
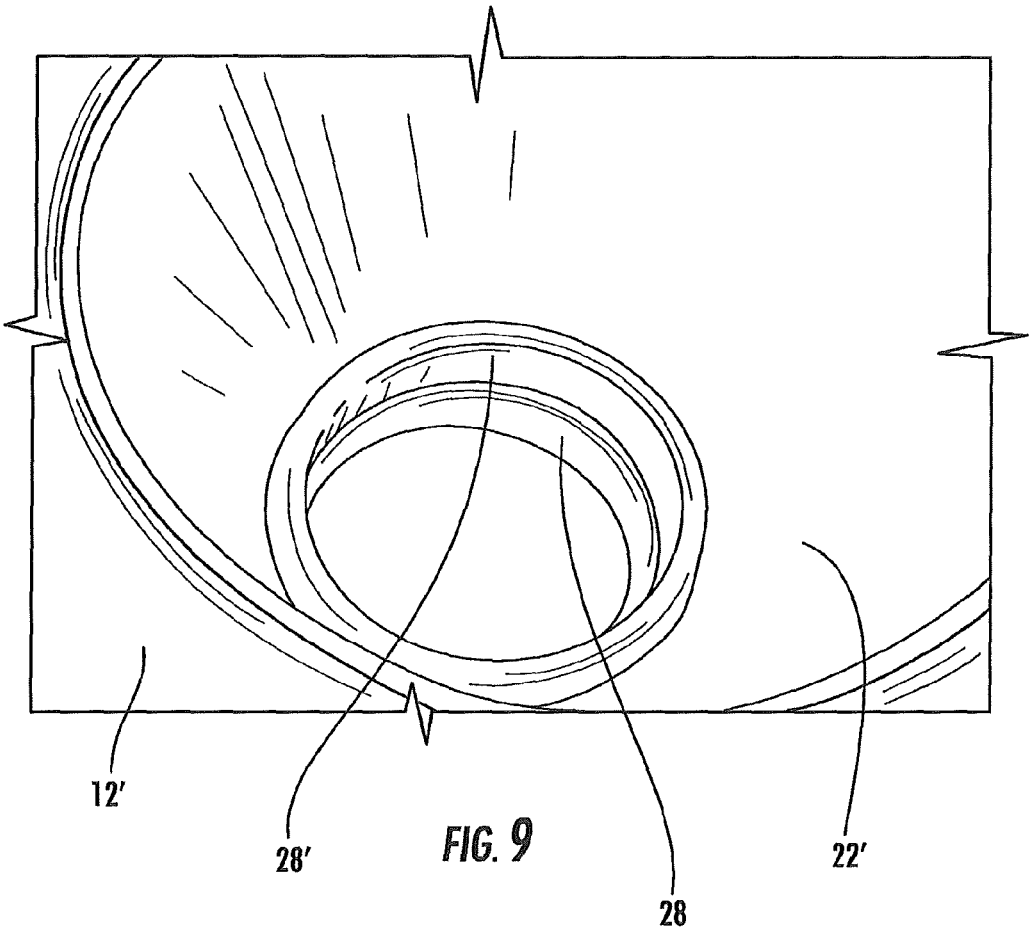
FIG. 9 is yet another partial perspective view of the pallet of FIG. 1.
Figure 10:
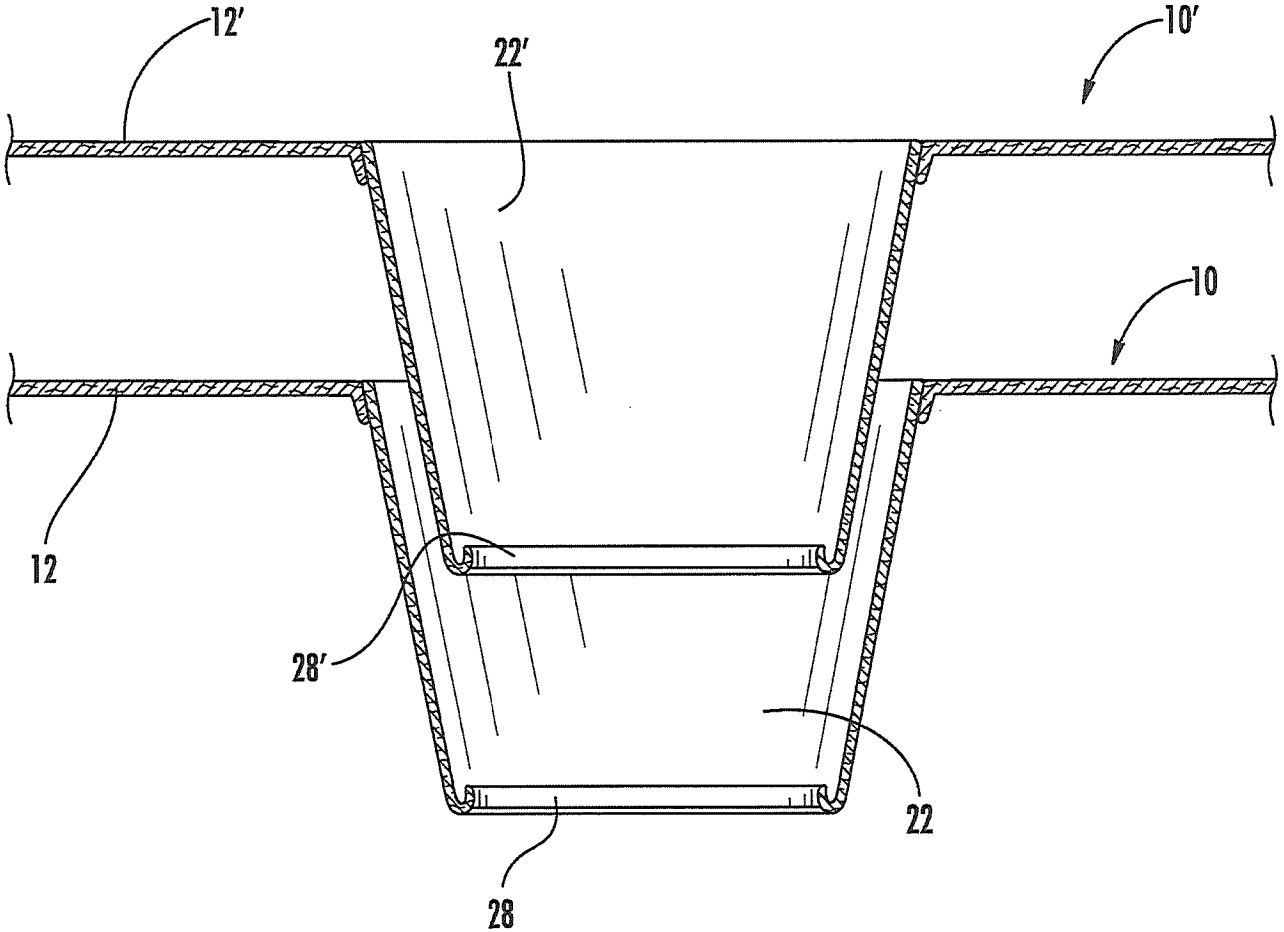
FIG. 10 is a partial cross sectional view of the pallet of FIG. 1.

As shown in FIGS. 8-10, the pallet 10 can be nested within another like pallet 10', and vice versa. As shown in FIGS. 9 and 10, the bull nose 28 of the first pallet 10 provides a stop for the leg 22' of a second pallet 10' that is being nested within the first pallet 10. As such, the second pallet 10' is prevented from sliding all the way to the end of the leg 22 of the first pallet 10, thereby preventing the two pallets 10, 10' from getting stuck too tightly together while in storage. This facilitates separation of the two pallets 10, 10' when it is desired to next use the pallets 10, 10' for material transport. Additional pallets can be nested, such as is illustrated in FIG. 8, which shows the nesting of four pallets 10.

In addition to facilitating separation of nested pallets 10, 10', the bull nose 28 also adds radial and axial strength to the leg 22, which compensates for the absence of a bottom panel in the leg 22, enabling the pallet 10 to withstand heavier loads. Preferably, the pallet 10 can support an evenly distributed mass of about 600 kg. Furthermore, the bull nose 28 provides a smooth surface at the bottom of the leg 22 that facilitates sliding movement of the pallet 10 on a supporting surface such as the ground or floor.

Figure 11:
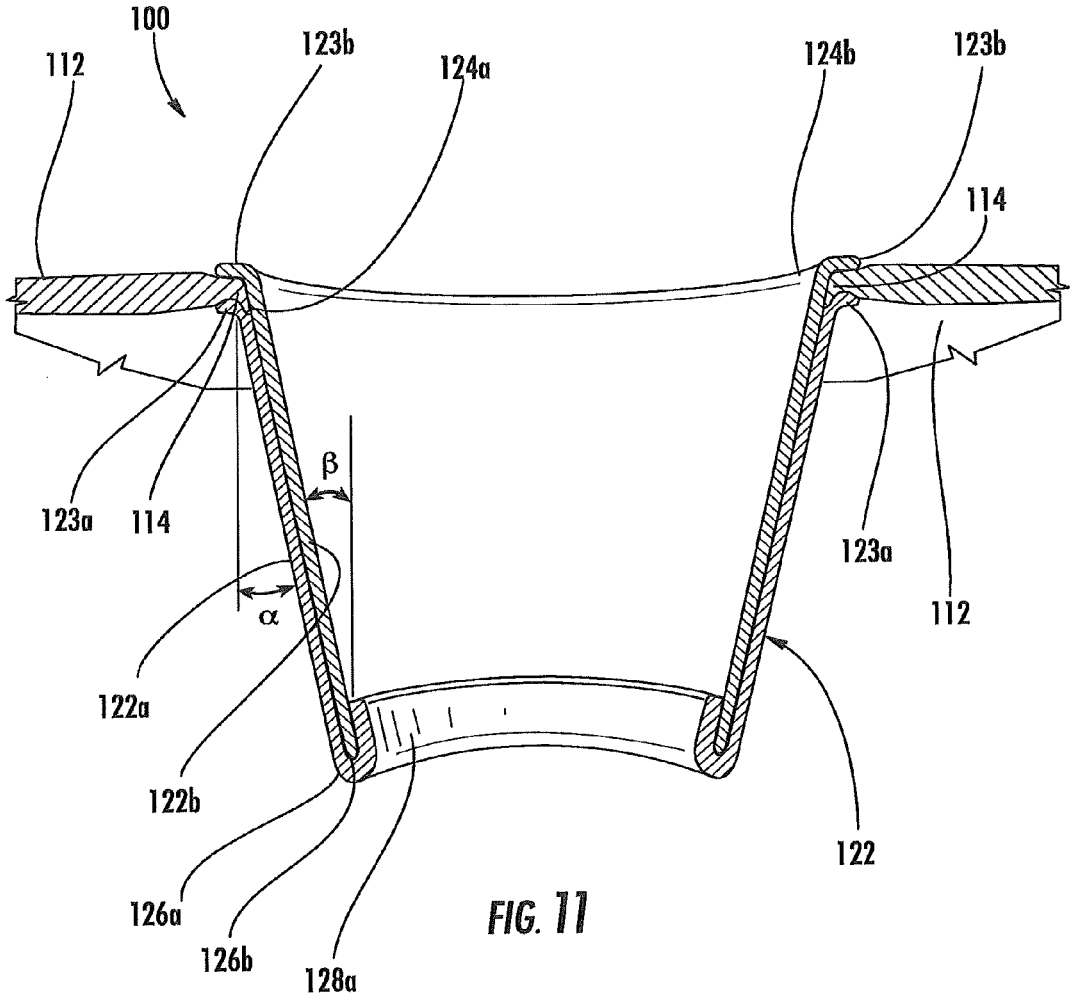
FIG. 11 is a partial cross sectional view of a pallet according to another embodiment of the invention.
Figure 12:
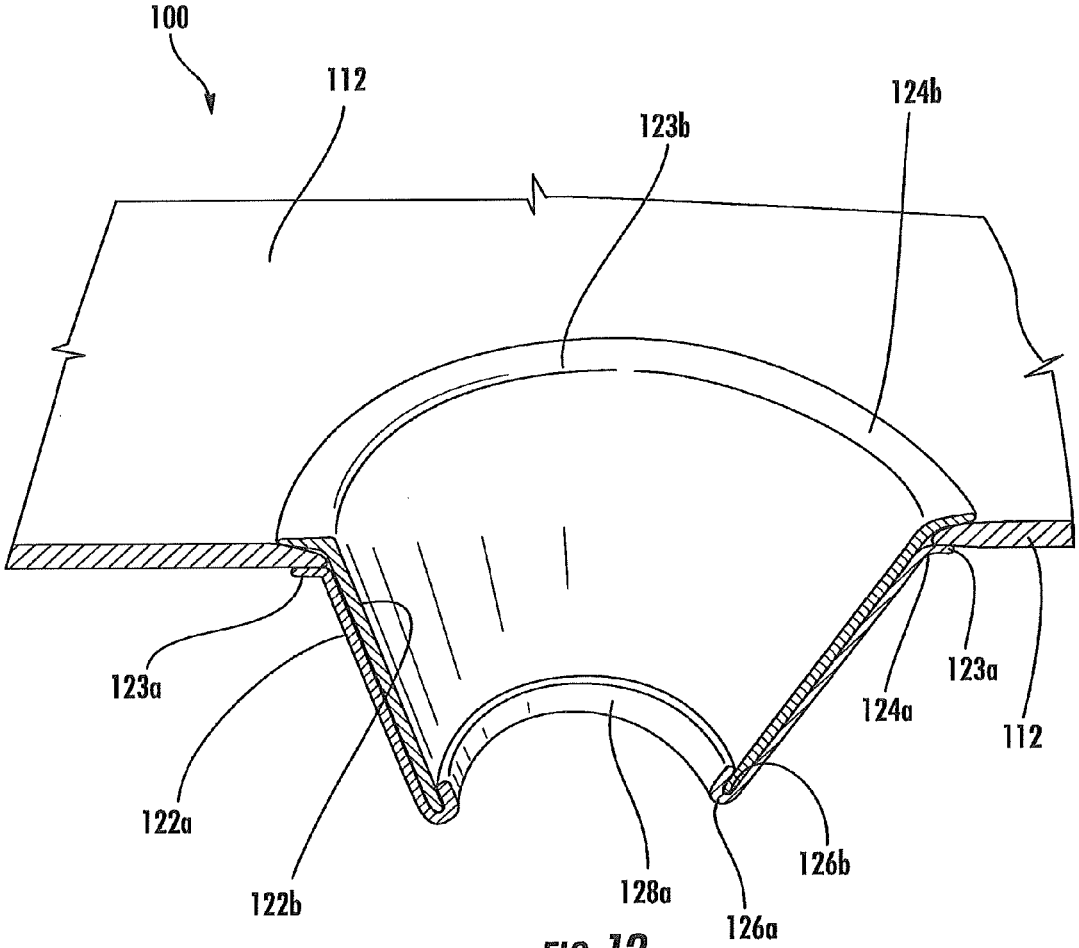
FIG. 12 is another partial cross sectional view of the pallet of FIG. 11.

A pallet according to another embodiment of the invention is illustrated in FIGS. 11-12, and shown generally at reference numeral 100. The pallet 100 is similar in construction to the previously described pallet 10, except that each leg 122 of the pallet 100 has two cones 122*a*, 122*b*. This construction adds strength to the legs 122 and enables the pallet 100 to withstand heavier loads.

Each cone 122*a*, 122*b* has flared portions 123*a*, 123*b*, respectively, extending outward from the large diameter ends 124*a*, 124*b* of the cones 122*a*, 122*b*. An adhesive, such as ethylene vinyl acetate (EVA) glue, is sprayed or spread onto the flared portion 123*a* of the outer cone 122*a*, which is then pressed on the lower surface of the platform 112 of the pallet 100. Adhesive is sprayed at the inner surface of the small diameter end 126*a* of the outer cone 122*a* within the area between the bull nose 128*a* and the sidewall of the cone 122*a*. Adhesive is placed on the flared portion 123*b* of the inner cone 122*b*, and the inner cone 122*b* is positioned on top of the outer cone 122*a*, such that the flared portion 123*b* of the inner cone 122*b* rests on the upper surface of the platform 112. The small diameter end 126*b* of the inner cone 122*b* contacts the adhesive in the crevice of the bull nose 128*a* of the outer cone 122*a* to adhere the outer cone 122*a* and the inner cone 122*b* together. The inner cone 122*b* does not have a bull nose.

As shown in FIG. 11, the outer cone 122*a* is sloped at an angle a relative to the vertical axis that is greater than the sloped angle i3 of the inner cone 122*b*. Preferably, the angle a of the outer cone 122*a* is about ten degrees, and the angle$_R$ of the inner cone 122*b* is about eight degrees. This results in an area between the flared portions 123*a*, 123*b* of the outer cone 122*a* and inner cone 122*b*, respectively, within which a portion 114 of the platform 112 can be sandwiched.

Figure 11A:
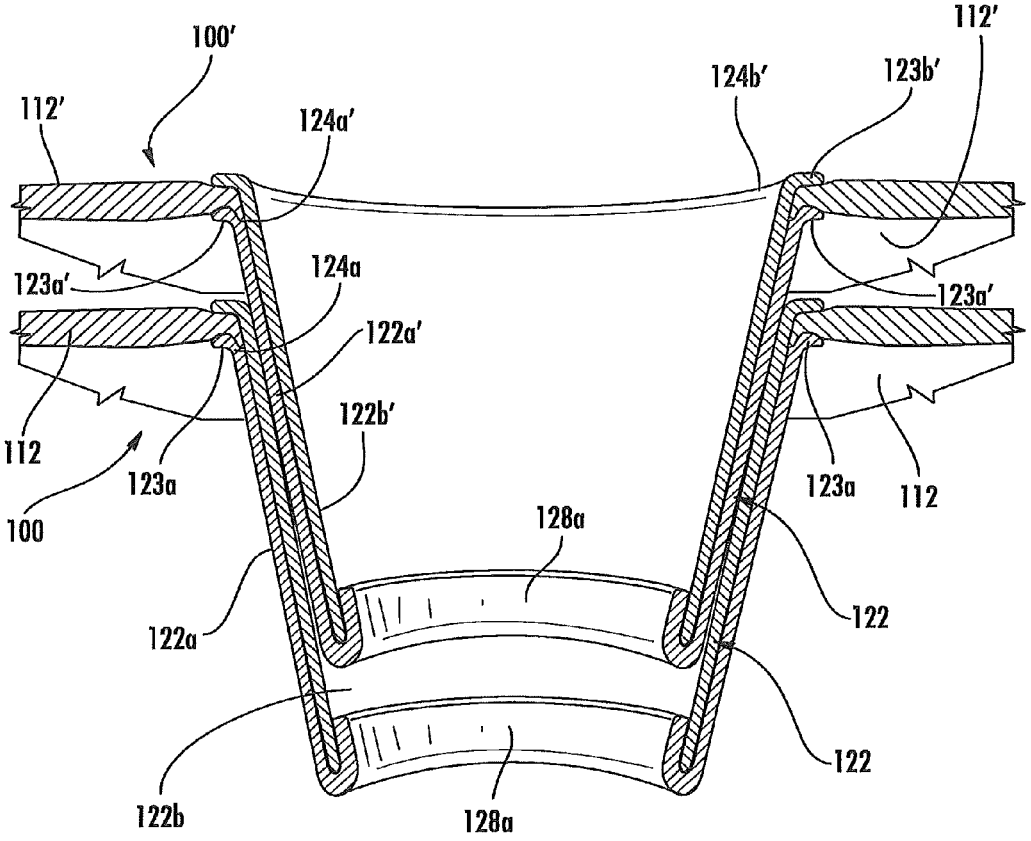
FIG. 11A is a partial cross sectional view of the pallet of FIG. 11, shown in use with a second similar pallet.

As shown in FIG. 11A, the leg 122' of a second pallet 100' can be nested within the leg 122 of the pallet 100, and since the outer cone 122*a'* of leg 122' of the nesting pallet 100' has a slightly greater angle a than the angle 13 of the inner cone 122*b* of the receiving pallet 100, the nesting pallet 100' is not allowed to descend all the way to the very bottom of the leg 122 of the receiving pallet 100. This prevents the two pallets 100, 100' from becoming stuck to tightly together and facilitates easy separation of the two pallets 100, 100'.

The pallet 100 can be made of corrugated paper, or other suitable material including moisture resistant paper board. It should be noted that the term "paper" as used throughout this application refers generally to all kinds of paper, including cardboard.

Figure 13:
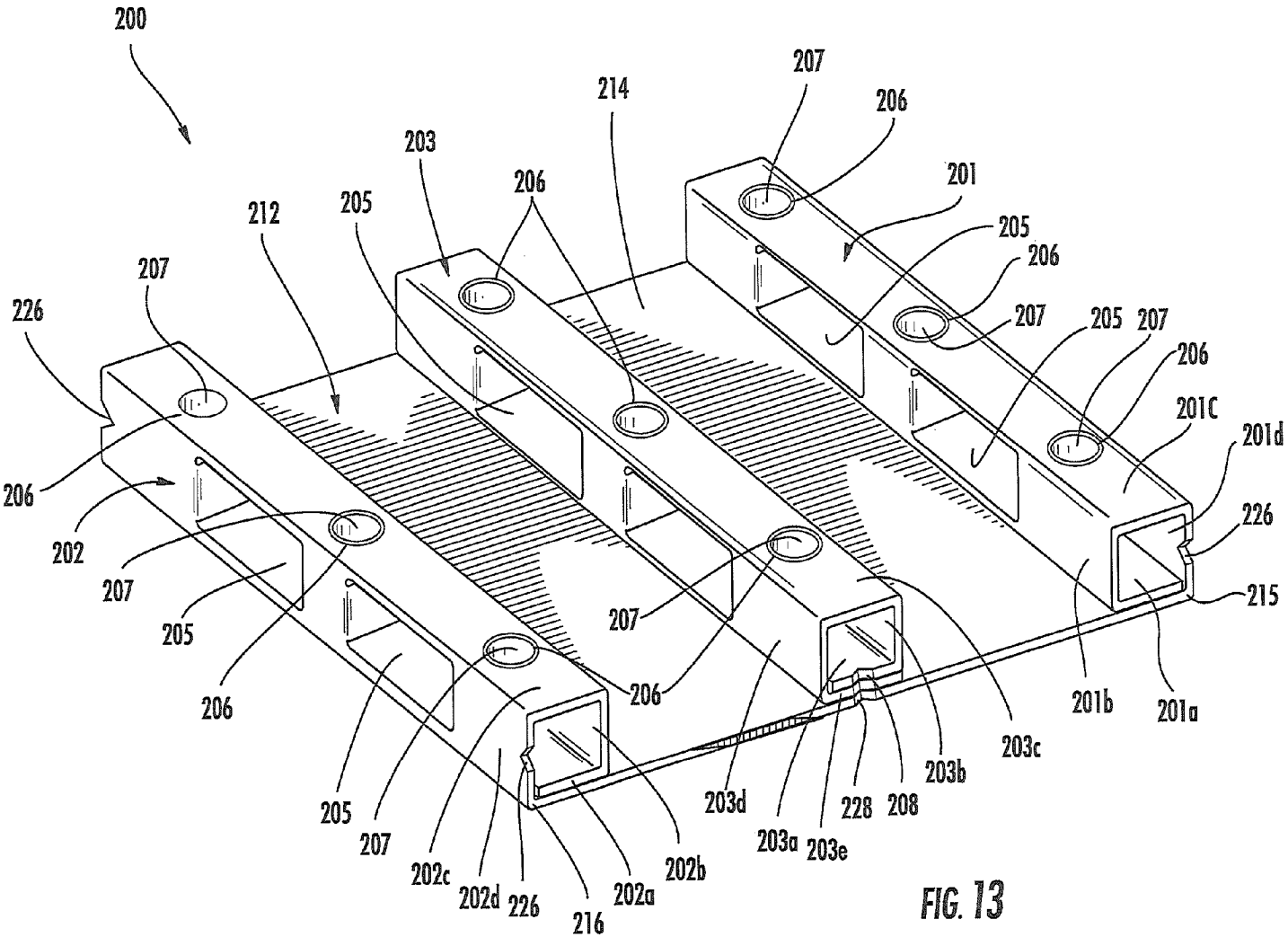
FIG. 13 is a perspective view of a pallet according to another embodiment of the invention.
Figure 14:
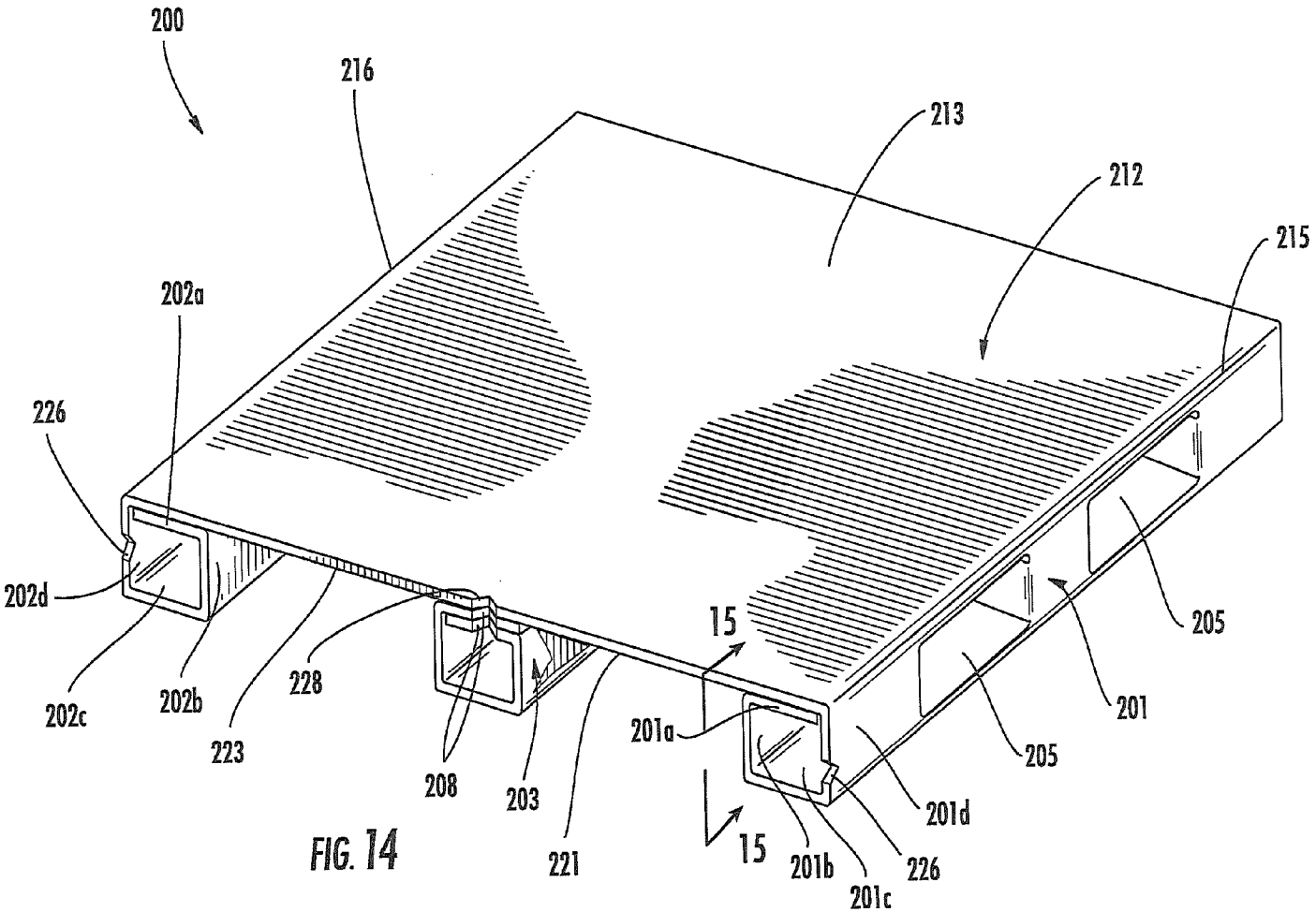
FIG. 14 is another perspective view of the pallet of FIG. 13.

A pallet according to another embodiment of the invention is illustrated in FIGS. 13 and 14, and shown generally at reference numeral 200. The pallet 200 includes a platform 212 and three leg members 201, 202, 203.

The platform 212 has a top side 213 for carrying objects, and an under side 214 opposite the top side 213. While the platform 212 is preferably rectangular as shown in FIGS. 13 and 14, it can be a variety of suitable shapes. Three leg members 201, 202, 203 are positioned on the under side 214 of the platform in substantially parallel relation to each other. The first leg member 201 is positioned at one end 215 of the platform 212, and the second leg member 202 is positioned at the opposite end 216 of the platform 212. The third leg member 203 is positioned intermediate the first and second leg members 201, 202 at approximately the center of the platform 212. The leg members 201, 202, 203 are substantially parallel with each other.

As shown in FIG. 13, each of the three leg members 201, 202, 203 are rectangular, and extend across the width of the platform 212. As such, the first and second leg members 201, 202 are coextensive with the first and second ends 215, 216, respectively, of the platform 212.

The first and second leg members 201, 202 each have four walls 201*a-d*, 202*a-d*, respectively. The third leg member 203 has a total of five walls 203*a-e*. While the leg members 201, 202, 203 are preferably rectangular, they can be a variety of shapes, such as conical, triangular or other polygonal shape. In addition, the number of leg members can be varied.

The first walls 201*a*, 202*a*, 203*a* of the leg members 201, 202, 203 lie flat on the under side 214 of the platform 212. The second walls 201*b*, 202*b*, 203*b* extend perpendicularly from the first walls 201*a*, 202*a*, 203*a* and the third walls 201*c*, 202*c*, 203*c* extend perpendicularly from the second walls 201*b*, 202*b*, 203*b*. The fourth walls 201*d*, 202*d*, 203*d* extend perpendicularly from the third walls 201*c*, 202*c*, 203*c* back toward the underside 214 of the platform 212. The fifth wall 203*e* of the third leg member 203 extends perpendicularly from the fourth wall 203*d* and lies parallel to and flat on the first wall 203*a*.

Each of the leg members 201, 202, 203 can have a pair of rectangular openings 205 formed in the second and fourth walls 201*b*, 201*d*, 202*b*, 202*d*, 203*b*, 203*d* of the leg members 201, 202, 203 and aligned on a horizontal axis that is substantially parallel with the platform 212. As such, fork-lift forks can be inserted through the openings 205 to engage and lift the pallet 200. Furthermore, the pallet 200 can be accessed by fork-lift forks from all four sides of the pallet by either inserting the fork-lift forks through the openings 205 in the leg members 201, 202, 203, or by insertion of forks in the space 221 between the first and third leg members and the space 223 between second and third leg members.

Figure 15:
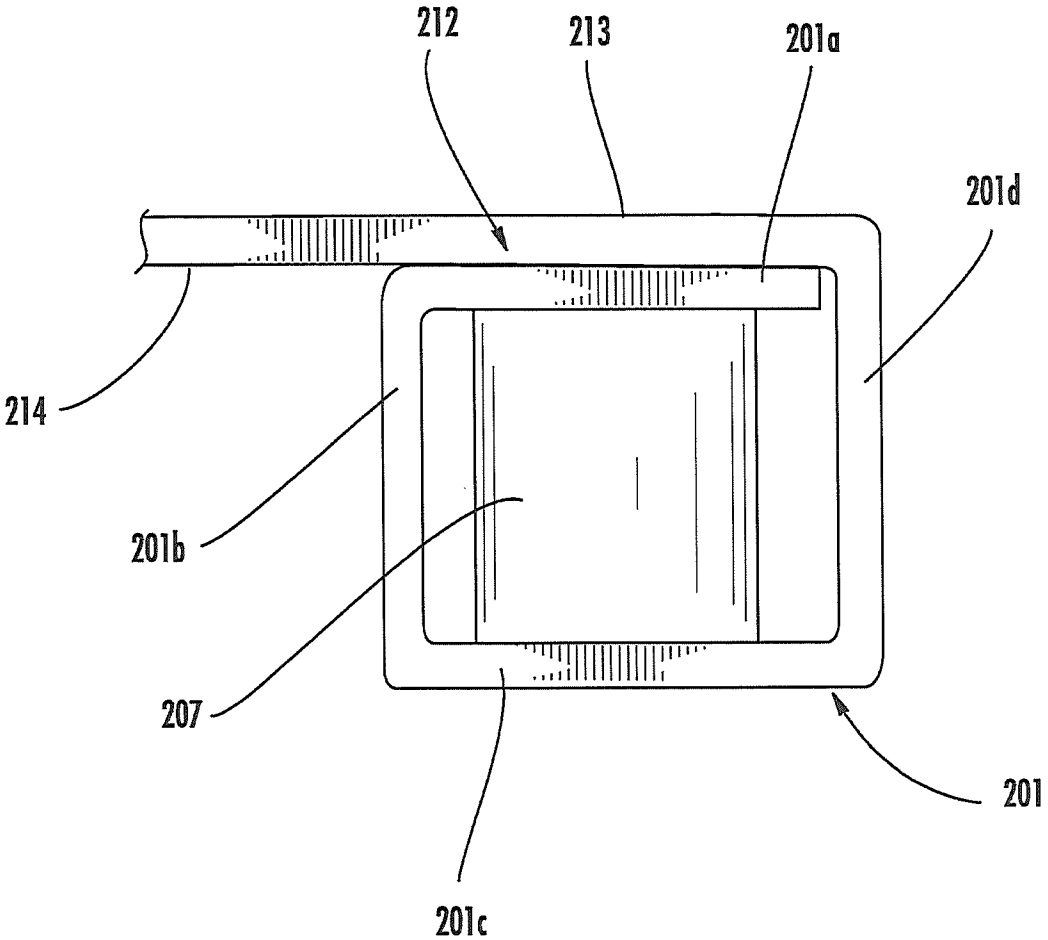
FIG. 15 is a partial cross sectional view of the pallet of FIG. 14, taken along lines 15-15.

Each of the leg members 201, 202, 203 can have a plurality of openings 206 formed on the third wall 201*c*, 202*c*, 203*c* of the leg members 201, 202, 203. A support member, such as a conical paper tube 207, can be positioned within each of the openings 206. The tubes 207 are positioned within the openings 206 of the leg members 201, 202, 203 such that the tubes 207 reside in perpendicular relation to the platform 212, as shown in FIG. 15. The tubes 207 provide added strength and stability to the leg members 201, 202, 203 to enable the pallet 200 to carry heavier loads.

Figure 16:
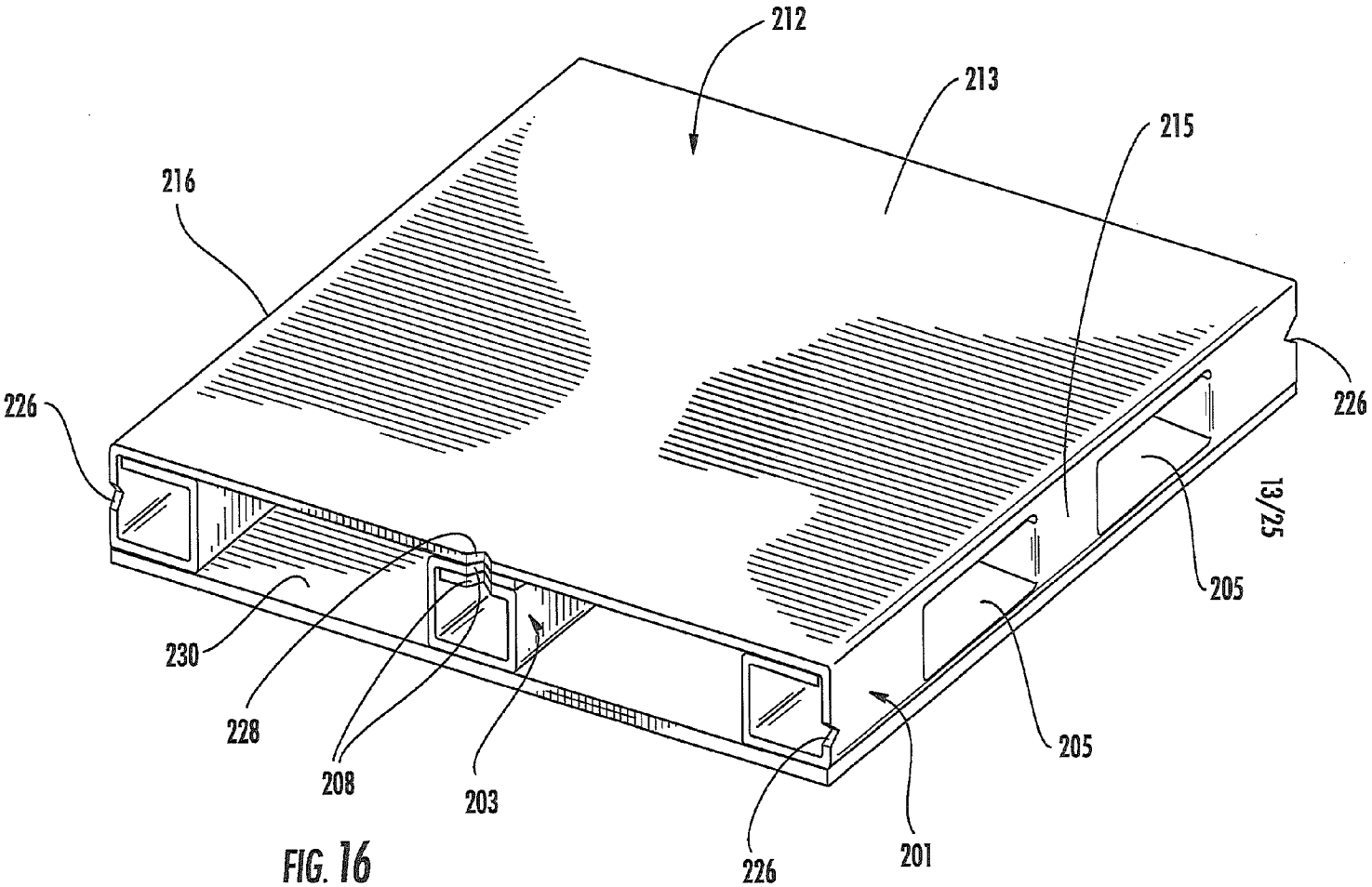
FIG. 16 is a perspective view of a pallet according to yet another embodiment of the invention.

The leg members 201, 202, 203 can be positioned directly on a ground surface and thereby support the platform 212 above the ground surface. Alternatively, the leg members 201, 202, 203 can be mounted on a substantially flat base member 220, as shown in FIG. 16. The base member 230 can be positioned on a ground surface.

Figure 17:
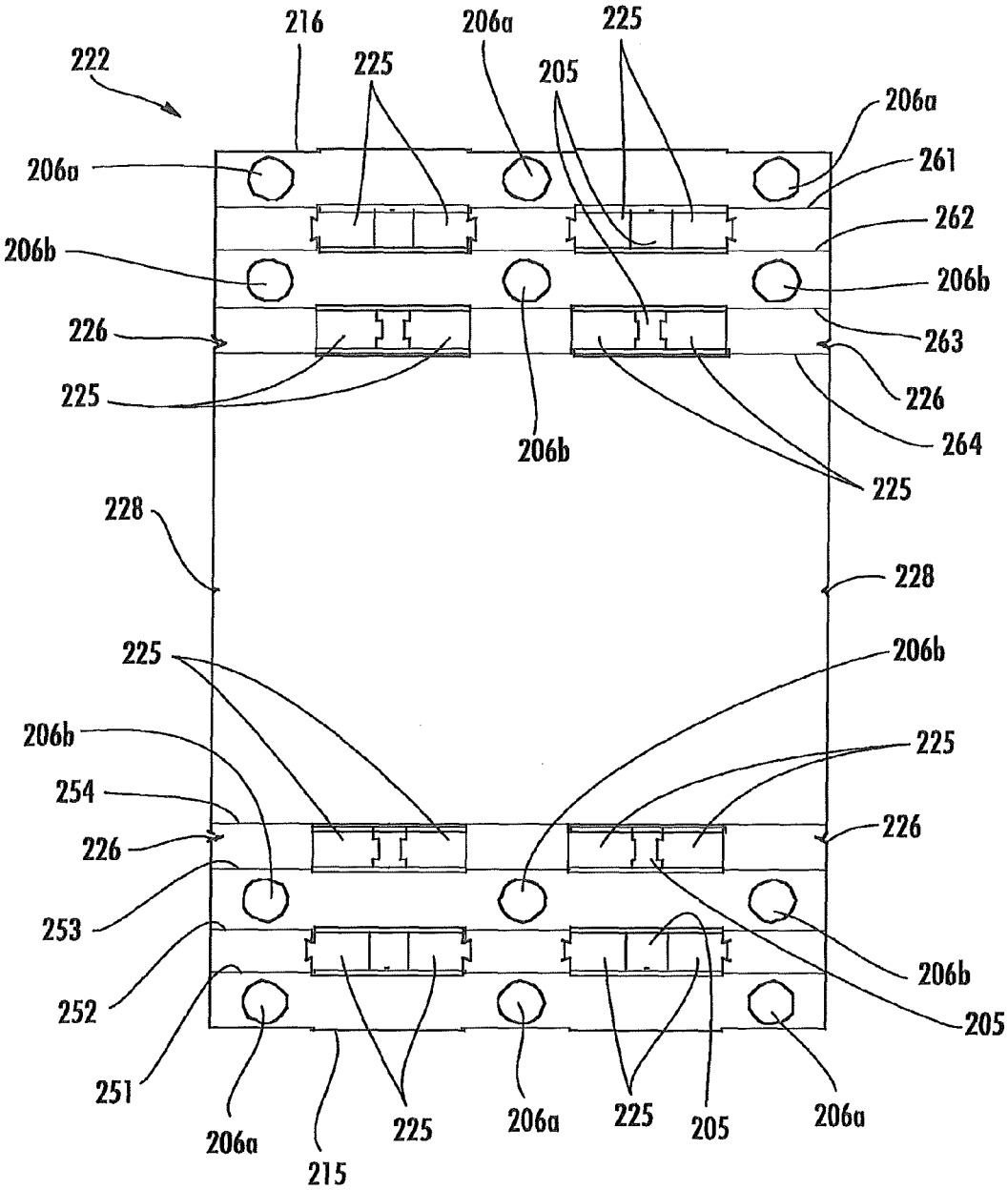
FIG. 17 is a top plan view of a die cut sheet for use in a method of making the pallet of FIG. 13.

A method of making the pallet 200 is illustrated in FIGS. 17-21. A blank sheet of material, such as a paper die cut sheet 222, is provided as shown in FIG. 17. Four fold lines 251, 252, 253, 254 are formed at one end 215 of the sheet 222, and four fold lines 281, 262, 263, 264 are formed at the opposite end 216 of the sheet. Perforated sections 225 are positioned between the first and second fold lines 251, 261, 252, 262, and between the third fold lines 253, 263 and fourth fold lines 254, 264 of the sheet 222. A first plurality of linearly aligned circular openings 206*a* are formed between the first and second ends 215, 216 of the sheet 222 and the first fold lines 251, 261, respectively, of the sheet 222. A second plurality of linearly aligned circular openings 206*b* are formed between the second fold lines 252, 262 and the third fold lines 253, 263 of the sheet 222.

Figure 18:
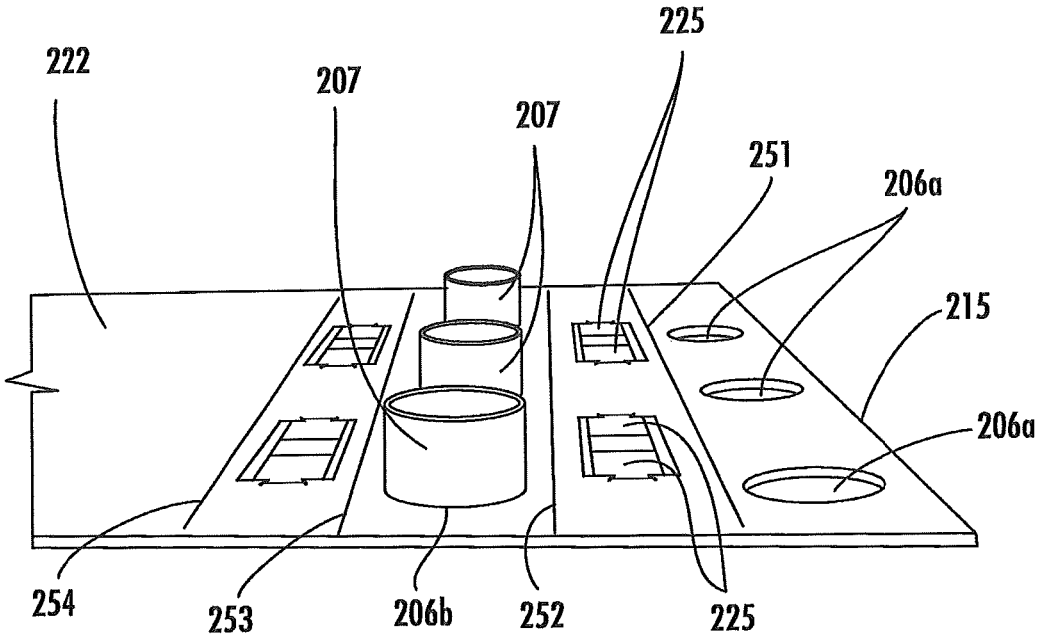
FIGS. 18-21 are partial perspective views illustrating a method of making the pallet of FIG. 13.
Figure 19:
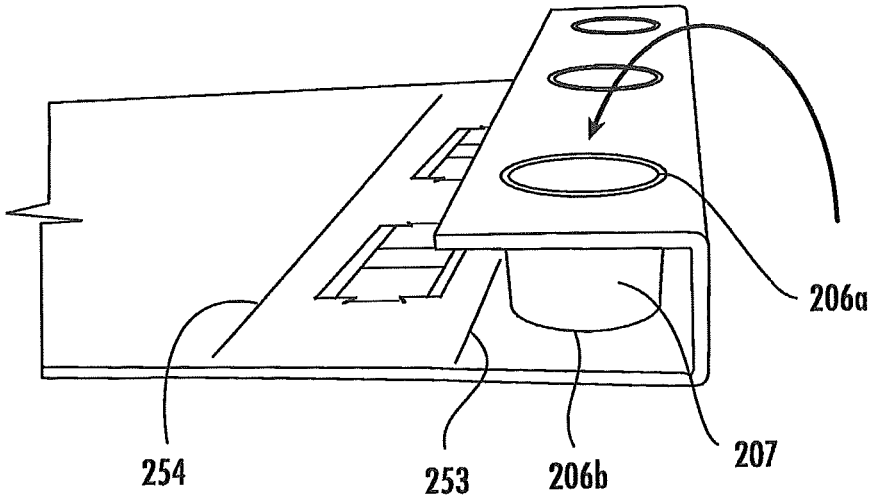
Figure 20:
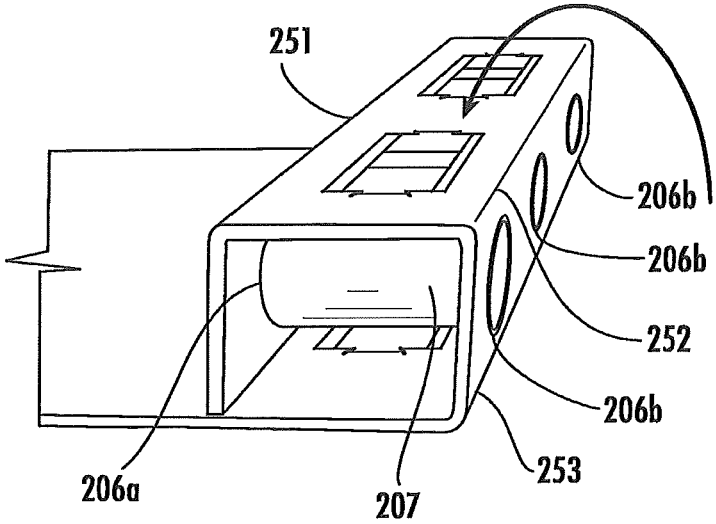
Figure 21:
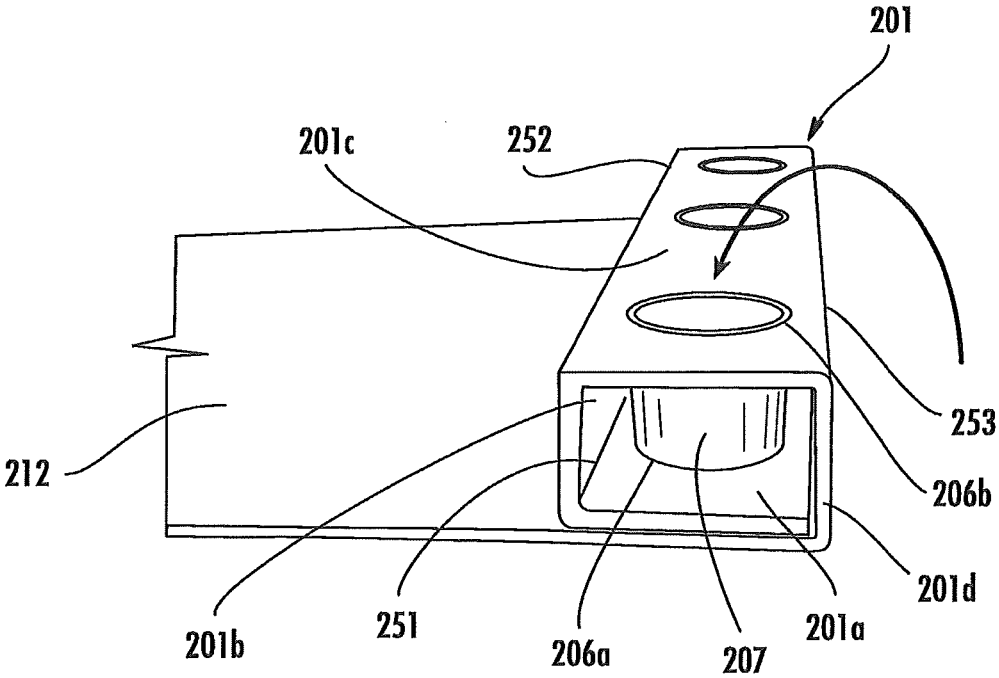

As shown in FIG. 18, the bottom of the support tubes 207 are positioned within circular openings 206*b* on the sheet 222. The first end of the 215 of the sheet 222 is folded over at ninety degree angles at the first and second fold lines 251, 252 such that the top of the support tubes 207 are positioned within the circular openings 206*a*, as shown in FIG. 19. The support tubes 207 have a diameter slightly less than the diameter of the openings 206*a*, 206*b* such that the tubes 207 are held in place within the openings 206*a*, 206*b* by frictional engagement. The sheet 222 is folded at ninety degree angles at the third and fourth fold lines 253, 254 to form the rectangular leg member 201 having four walls 201*a-d*, shown in FIG. 21. An adhesive can be applied to the sheet 222 to attach wall 201*a* thereto. Alternatively, other suitable attachment means can be employed to hold the leg member 201, such as staples, nails or other fasteners. The second leg member 202 is made in the same manner as the first leg member 201, and therefore the process is not described again here.

As shown in FIG. 17, the sheet 222 has two pairs of notches 226 formed at opposite ends of the sheet 222 between the third fold lines 253, 263 and the fourth fold lines 254, 264. When the sides 215, 216 of the sheet 222 are folded to form the leg members 201, 202 as described above, the notches 226 are positioned at the four corners of the pallet 200 on the fourth walls 201*d*, 202*d* of the leg members 201, 202, respectively, as shown in FIG. 13. These notches 226 provide an area for receiving and holding a wrapping material, such as polyvinylidene chloride or other plastic wrap that is to be wrapped around the pallet 200 and the objects being carried on the pallet 200.

The third leg member 203 is a separate piece that can be attached at the center for the sheet 222 between the first end 215 and second end 216. As shown in FIG. 17, the sheet 222 has two notches 228 located at opposite sides of the center of the sheet 222. The third leg member 203 likewise has notches 208 at opposite ends formed in the center of the first and fifth walls 203*a*, 203*e*. As such, proper positioning of the third leg member 203 on the sheet 222 is readily obtained by aligning the notches 208 of the leg member 203 with the notches 228 of the sheet 222, as shown in FIGS. 13 and 14. The third leg member 203 can be held in place on the sheet 222 by an adhesive placed on the first wall 203*a* of the leg member 203 or the sheet 222. Alternatively, other attachment means can be employed such as staples, nails or other fasteners.

When the first and second leg members 201, 202 have been formed, the perforated sections 225 can be partially detached therefrom to form flaps that can be folded inwardly into the leg members 201, 202 to form the openings 205, shown in FIG. 13. The flap sections can be held within the leg members 201, 202 by frictional engagement with the first walls 201*a*, 202*a* and third walls 201*c*, 202*c* of the leg members 201, 202, respectively.

Figure 22:
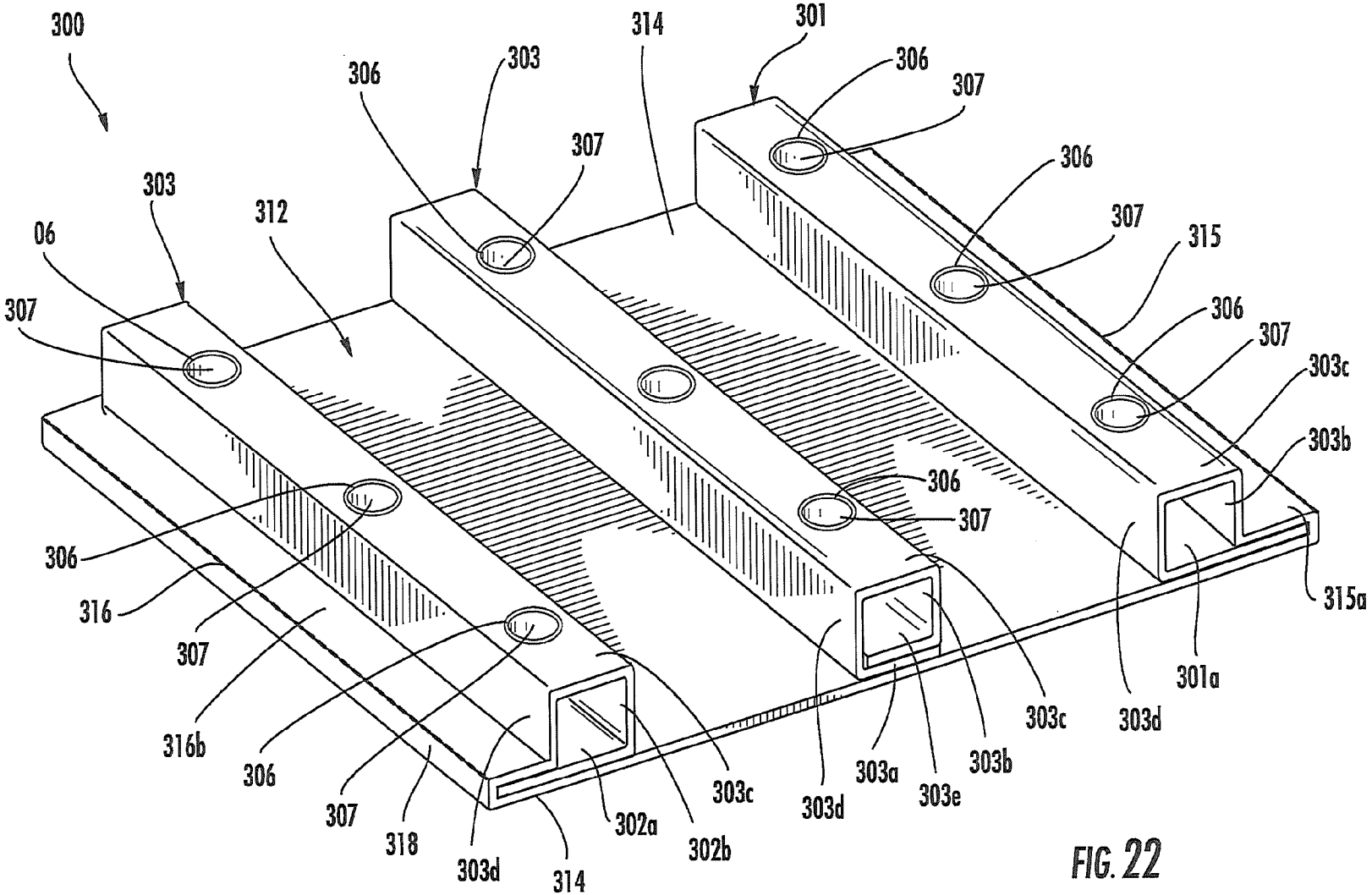
FIG. 22 is a perspective view of a pallet according to yet another embodiment of the invention.
Figure 23:
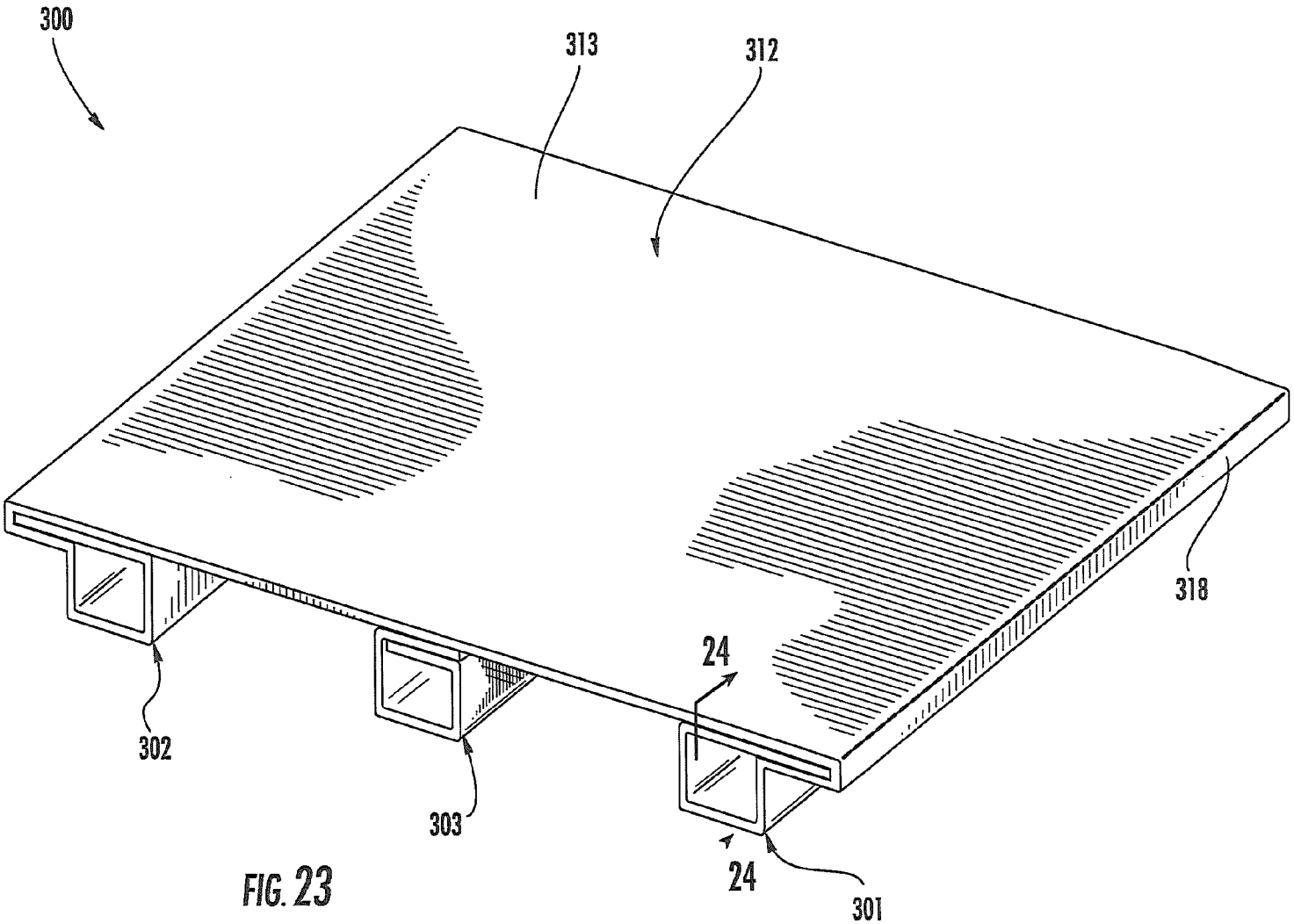
FIG. 23 is another perspective view of the pallet of FIG. 22.

A pallet according to yet another embodiment of the invention is illustrated in FIGS. 22 and 23, and shown generally at reference numeral 300. The pallet 300 includes a platform 312 and three leg members 301, 302, 303.

The platform 312 has a top side 313, shown in FIG. 23, for carrying objects thereon, and an under side 314, shown in FIG. 22, opposite the top side 313. While the platform 312 is preferably rectangular, it can be a variety of suitable shapes. Three leg members 301, 302, 303 are positioned on the under side 314 of the platform in substantially parallel relation to each other. The first leg member 301 is positioned proximate one end 315 of the platform 312, and the second leg member 302 is positioned proximate the opposite end 316 of the platform 312. The third leg member 303 is positioned intermediate the first and second leg members 301, 302 at approximately the center of the platform 312. The leg members 301, 302, 303 are substantially parallel with each other.

The three leg members 301, 302, 303 are rectangular, and extend across the width of the platform 312, as shown in FIG. 22. The first and second leg members 301, 302 each have four walls 301*a-d*, 302*a-d*, respectively. The third leg member 303 has a total of five walls 303*a-e*. While the leg members 301, 302, 303 are preferably rectangular, they can be a variety of shapes, such as conical, triangular or other polygonal shape. In addition, the number of leg members can be varied.

The first walls 301*a*, 302*a*, 303*a* of the leg members 301, 302, 303 lie flat on the under side 314 of the platform 312. The second walls 301*b*, 302*b*, 303*b* extend perpendicularly from the first walls 301*a*, 302*a*, 303*a* and the third walls 301*c*, 302*c*, 303*c* extend perpendicularly from the second walls 301*b*, 302*b*, 303*b*. The fourth walls 301*d*, 302*d*, 303*d* extend perpendicularly from the third walls 301*c*, 302*c*, 303*c* back toward the underside 314 of the platform 312, as shown in FIG. 22. The fifth wall 303*e* of the third leg member 303 extends perpendicularly from the fourth wall 303*d* and lies parallel to and flat on the first wall 303*a*.

The platform 312 includes wing sections 315*a*, 316*a* at opposite ends 315, 316, respectively, as shown in FIGS. 22 and 23. As shown in FIG. 22, the wing sections 315*a*, 316*a* extend outward perpendicularly from the fourth walls 301*d*, 302*d* of the first and second leg members 301, 302, respectively.

Figure 24:
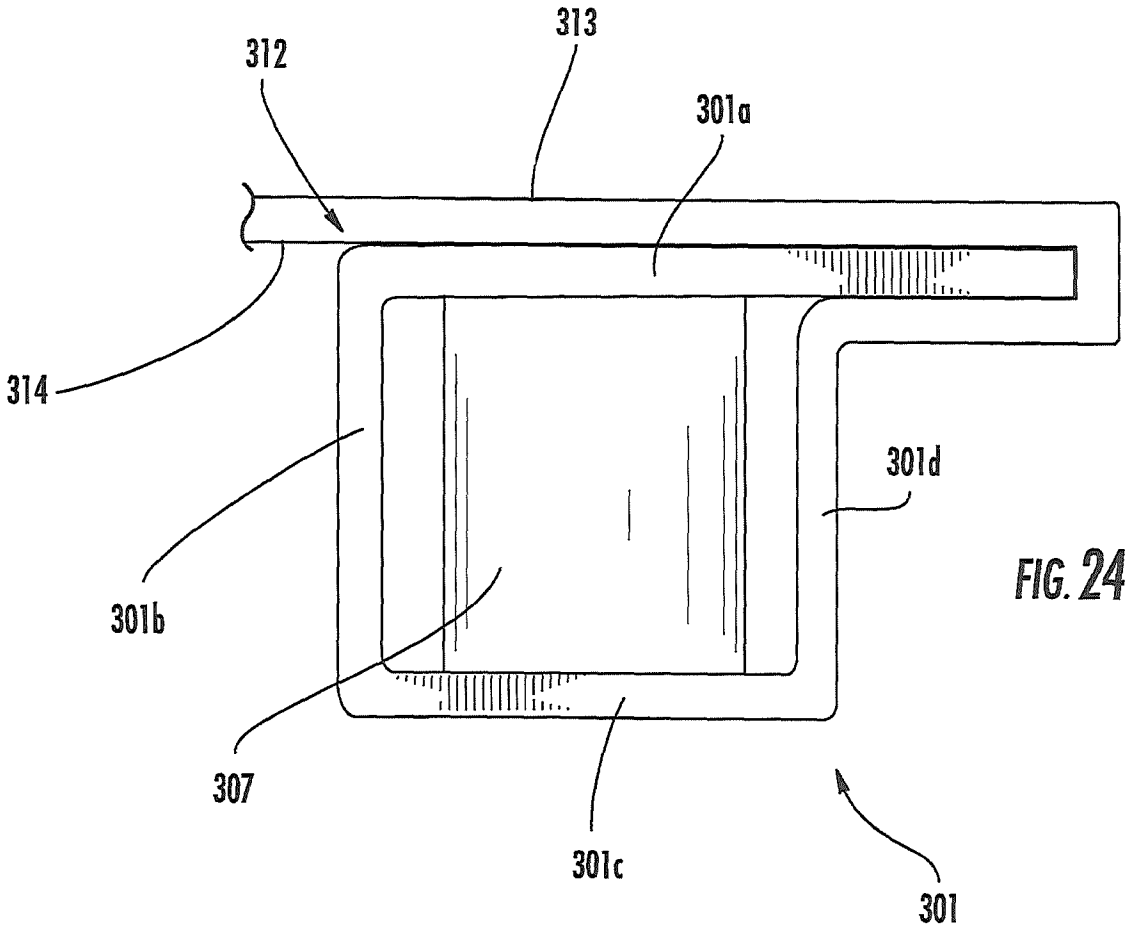
FIG. 24 is a partial cross sectional view of the pallet of FIG. 23, taken along lines 24-24.

Each of the leg members 301, 302, 303 can have a plurality of openings 306 formed on the third wall 301*c*, 302*c*, 303*c* of the leg members 301, 302, 303. A support member, such as conical paper tubes 307, can be positioned within the openings 306. The tubes 307 are positioned within the openings 306 of the leg members 301, 302, 303 such that the tubes 307 reside in perpendicular relation to the platform 312, as shown in FIG. 24. The tubes 307 provide added strength and stability to the leg members 301, 302, 303 to enable the pallet 300 to carry heavier loads.

Figure 25:
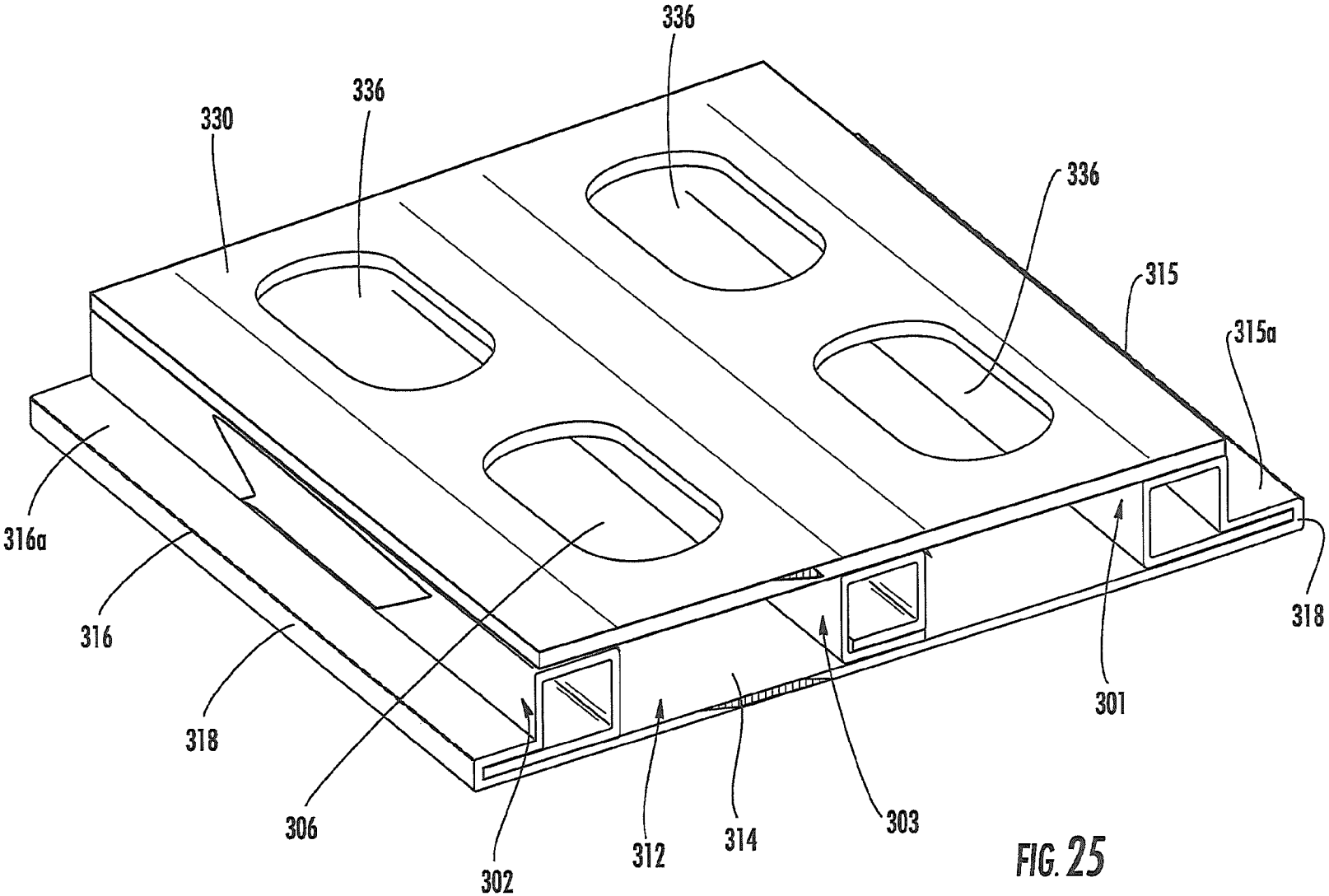
FIG. 25 is a perspective view of a pallet according to yet another embodiment of the invention.

The leg members 301, 302, 303 can be positioned directly on a ground surface and thereby support the platform 312 above the ground surface. Alternatively, the leg members 301, 302, 303 can be mounted on a substantially flat base member 330, as shown in FIG. 25. The base member 330 can be attached to the leg members 301, 302, 303 using an adhesive or other attachment means, such as staples, nails or other fasteners. The base member 330 can be positioned on a ground surface, and can include openings 336, which are shaped and sized to receive a pallet jack.

Figure 26:
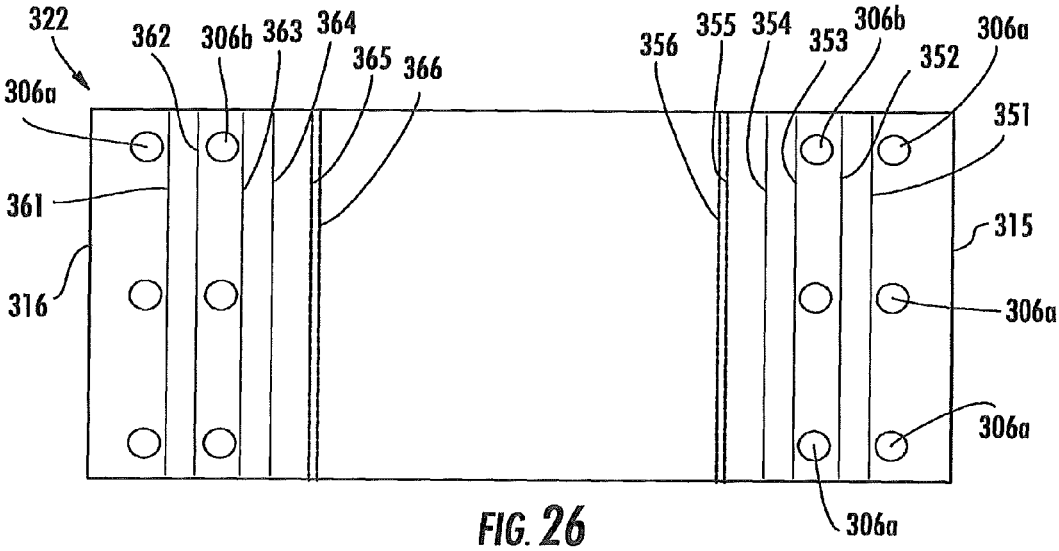
FIG. 26 is a top plan view of a die cut sheet for use in a method of making the pallet of FIG. 23.

A method of making the pallet 300 is illustrated in FIGS. 26-31. A blank sheet of material, such as a paper die cut sheet 322, is provided as shown in FIG. 26. Six fold lines 351, 352, 353, 354, 355, 356 are formed at one end 315 of the sheet 322, and six fold lines 361, 362, 363, 364, 365, 366 are formed at the opposite end 316 of the sheet 322. A first plurality of linearly aligned circular openings 306*a* are formed between the first and second ends 315, 316 of the sheet 322 and the first fold lines 351, 361, respectively, of the sheet 322. A second plurality of linearly aligned circular openings 306*b* are formed between the second fold lines 352, 362 and the third fold lines 353, 363 of the sheet 322.

Figure 27:
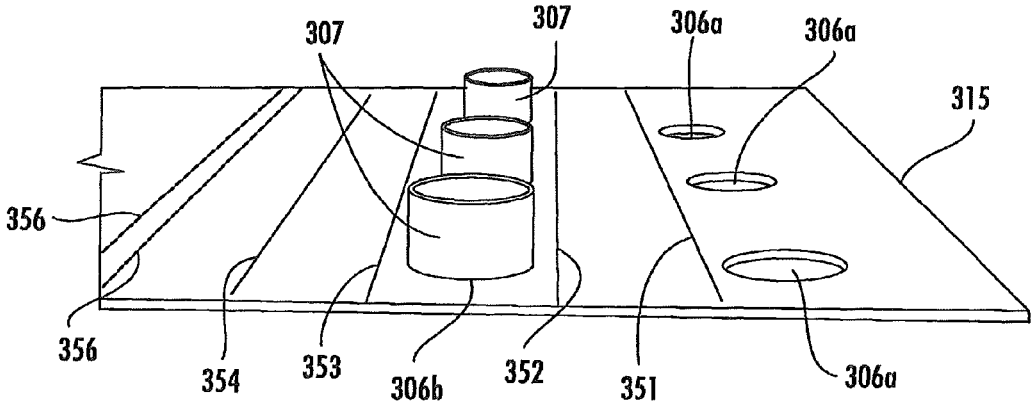
FIGS. 27-31 are partial perspective views illustrating a method of making the pallet of FIG. 23.
Figure 28:
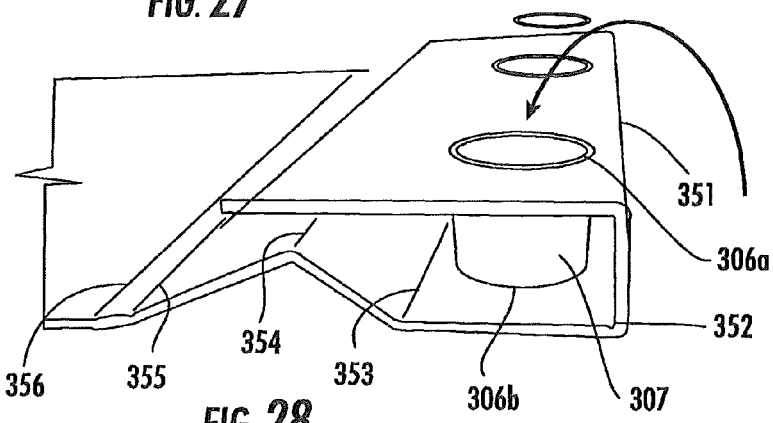
Figure 30:
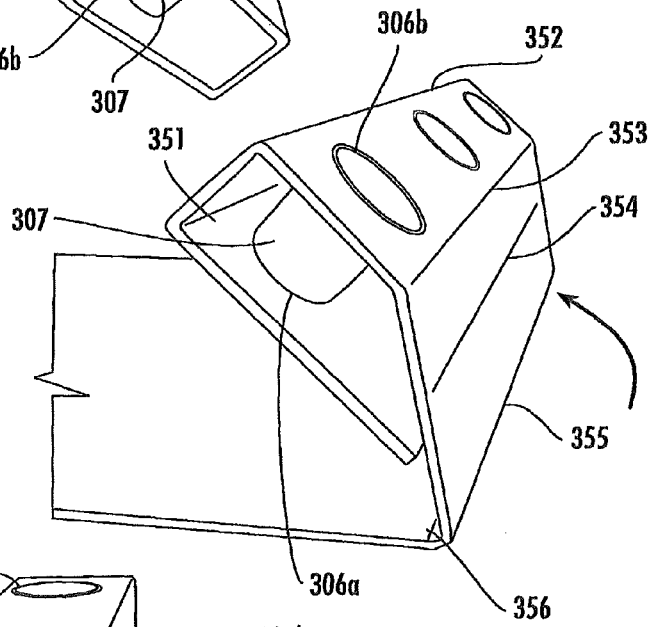
Figure 31:
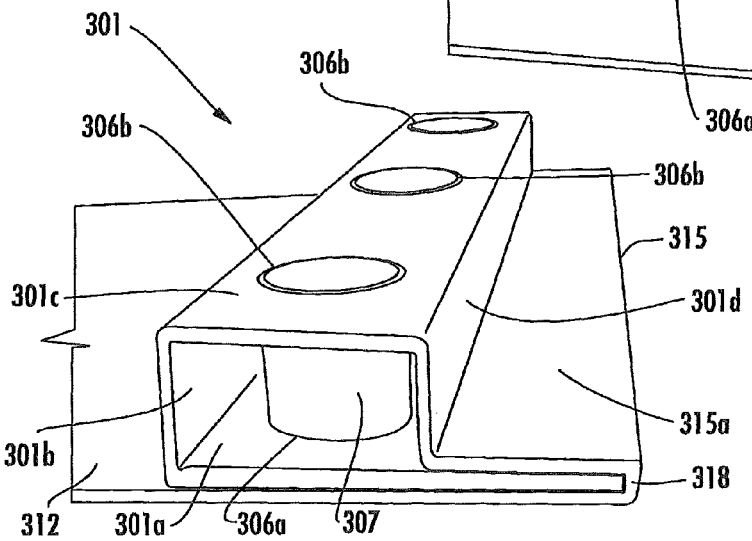

As shown in FIG. 27, the bottom of the support tubes 307 are positioned within circular openings 306*b* on the sheet 322. The first end 315 of the sheet 322 is folded over at ninety degree angles at the first and second fold lines 351, 352 such that the top of the support tubes 307 are positioned within the circular openings 306*a*, as shown in FIG. 28. The support tubes 307 have a diameter slightly less than the diameter of the openings 306*a*, 306*b* such that the tubes 307 are held in place within the openings 306*a*, 306*b* by frictional engagement. As shown in FIG. 30, the sheet 322 is folded at ninety degree angles at the third and fourth fold lines 353, 354 to form the rectangular leg member 301 having four walls 301*a-d*, shown in FIG. 31. The sheet is folded at ninety degree angles at the fifth and sixth fold lines 355, 356 to form a side edge 318 that joins the top side 313 and under side 314 of the platform 32

As shown in FIG. 26, the distance between the end 315 of the platform 322 and the first fold line 351 is greater than the distance between the first and second fold lines 351, 352, second and third fold lines 352, 353, and third and fourth fold lines 353, 354. The relatively greater distance between the end 315 of the platform 322 and the first fold line 351 result in the formation of the wing section 315*a* extending outward from the leg member 301.

Figure 29:
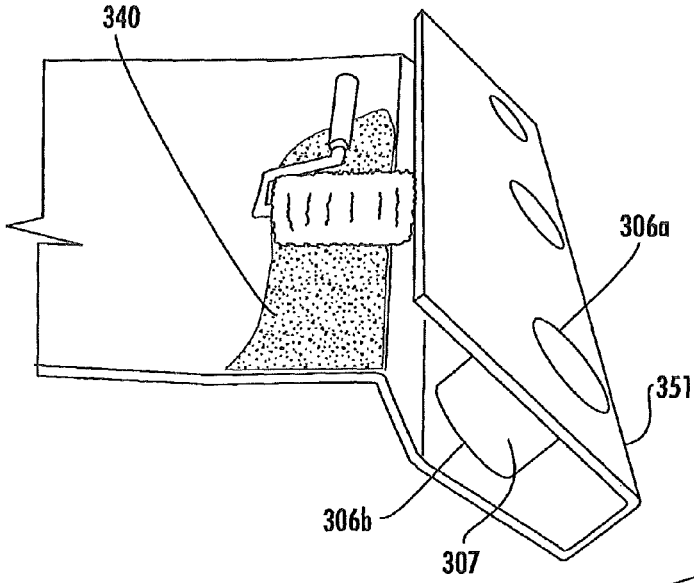

An adhesive can be applied to the sheet 322 to attach wall 301*a* thereto, as shown in FIG. 29. Alternatively, other suitable attachment means can be employed to hold the leg member 301 to the platform 322, such as staples, nails or other fasteners. The second leg member 302 is made in the same manner as the first leg member 301, and therefore the process is not described again here.

The third leg member 303 is a separate piece that can be attached at the center for the sheet 322 between the first end 315 and second end 316 of the platform 322. The third leg member 303 can be held in place on the sheet 322 by an adhesive 340 placed on the first wall 303*a* of the leg member 303 or the sheet 322. Alternatively, other attachment means can be employed such as staples, nails or other fasteners.

Figure 32:
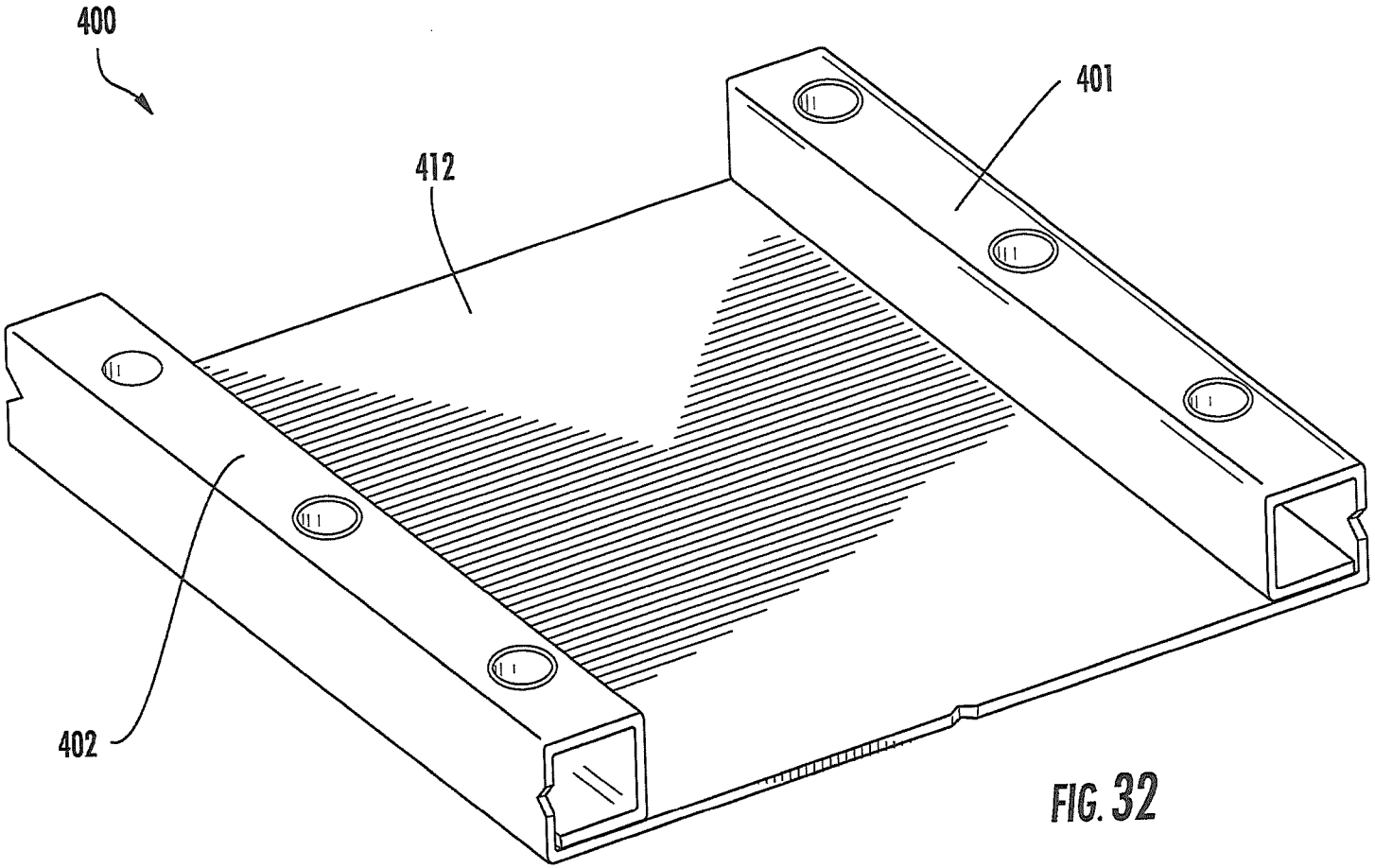
FIG. 32 is a perspective view of a pallet according to yet another embodiment of the invention.

Yet another alternative embodiment of the invention is illustrated in FIG. 32, and shown generally at reference numeral 400. The pallet 400 includes a platform 412 and two leg members 401, 402, and is similar to the previously described pallet 200, but does not have a third leg member between the first and second leg members 401, 402. One advantage of pallet 400 is that it can be made entirely of a single sheet of paper or other suitable material.

Figure 33:
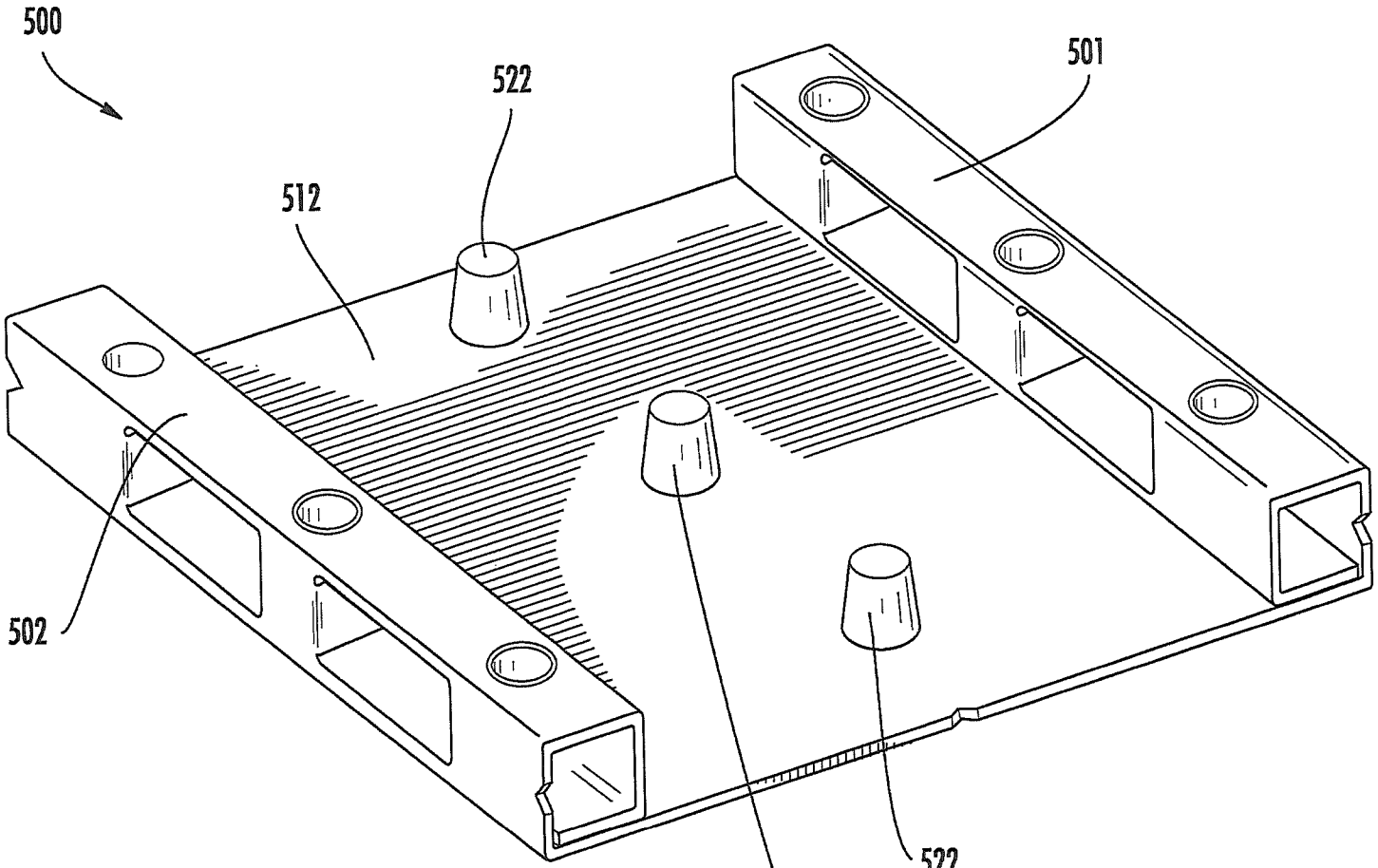
FIG. 33 is a perspective view of a pallet according to yet another embodiment of the invention.

A pallet according to yet another embodiment of the invention is illustrated in FIG. 33, and shown generally at reference numeral 500. The pallet 500 includes a platform 512, and two elongate rectangular leg members 501, 502. A plurality of conical leg members 522 are positioned between the two elongate rectangular leg members 501, 502, and are arranged in a line that is parallel with the rectangular leg members 501, 502. Although leg members 522 are conical, the leg members 522 can be other shapes such as tubular or square.

Figure 34:
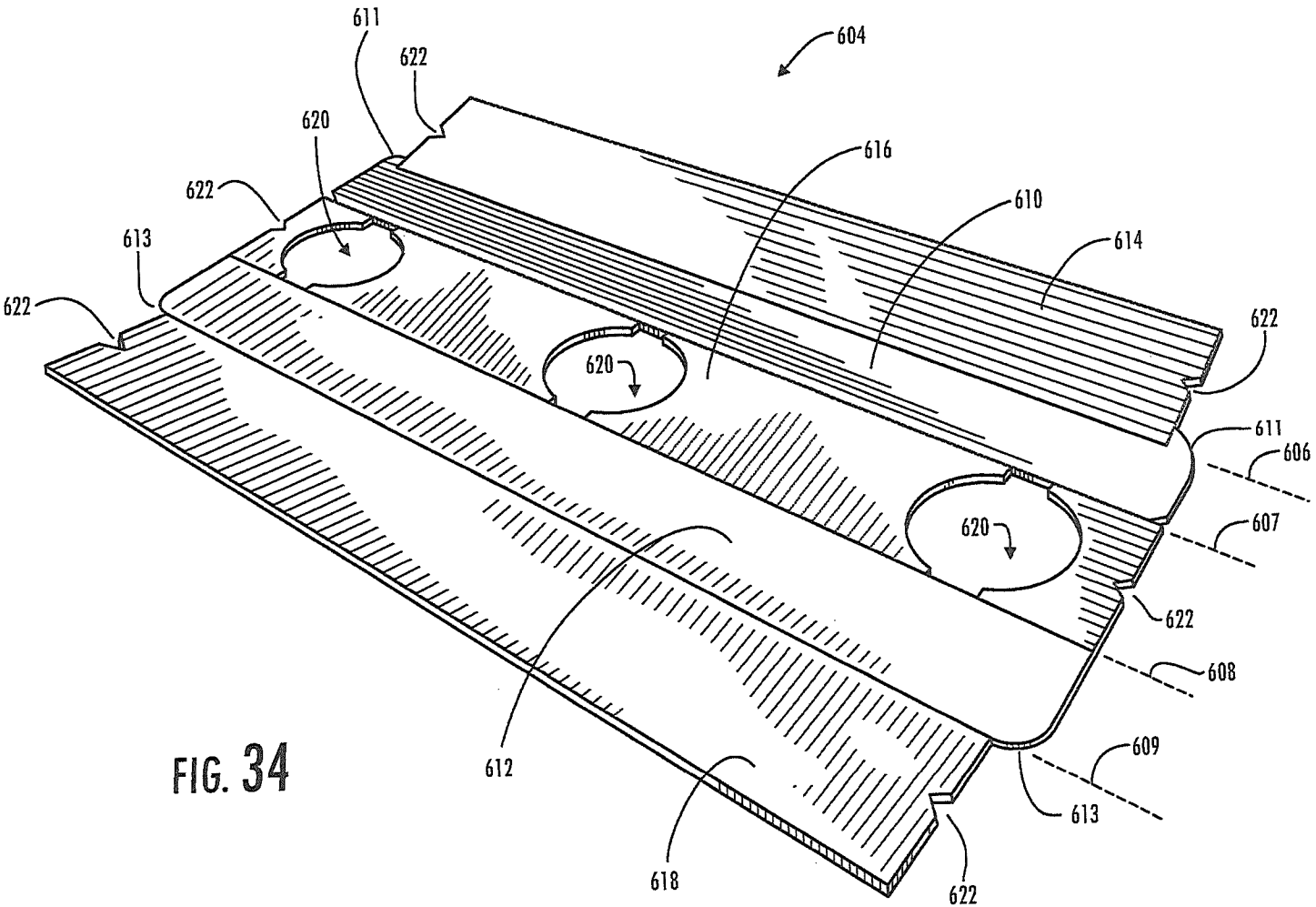
FIG. 34 is a perspective view of a paper blank used to form the pallet rail of FIG. 37.
Figure 35:
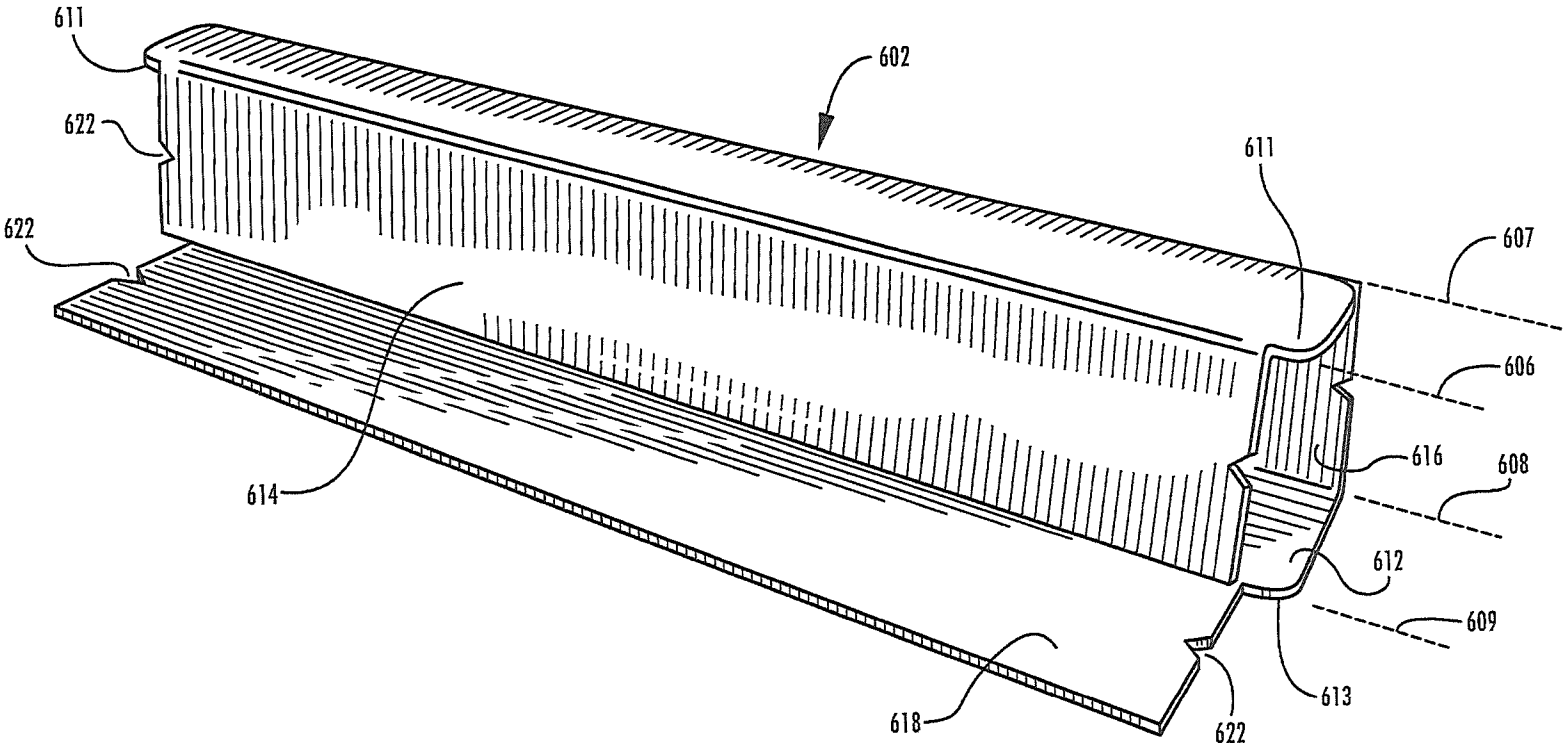
FIG. 35 is a perspective view of the paper blank of FIG. 34 shown folded along several fold lines in a stage of forming the pallet rail of FIG. 37.
Figure 36:
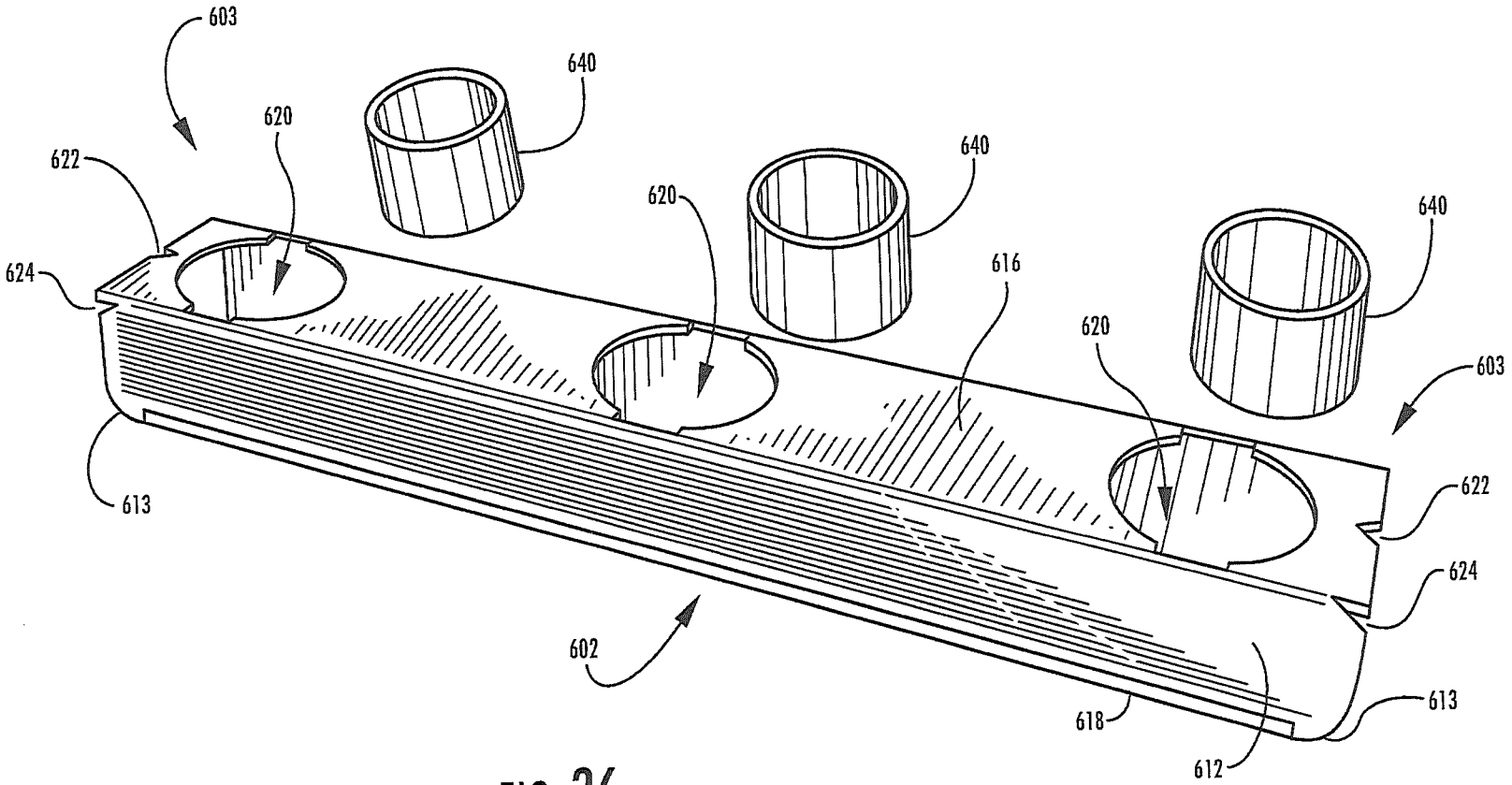
FIG. 36 is a perspective view of the paper blank of FIG. 34 folded to form an elongate support box and ready to receive reinforcing tubes.
Figure 37:
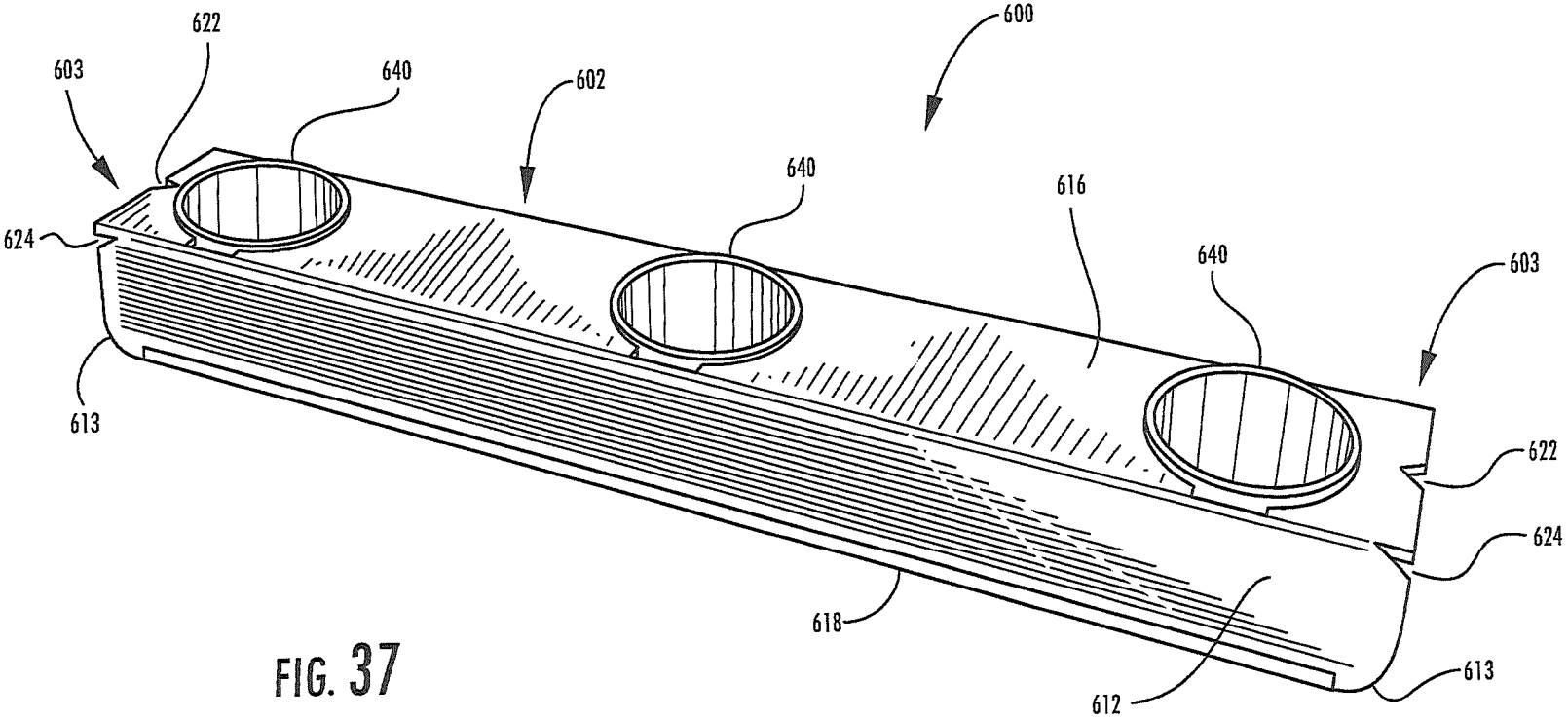
FIG. 37 is a perspective view a pallet rail, according to a first embodiment of the present invention, having longitudinal ends with curved lower profiles.

A pallet rail 600 according to at least one embodiment of the invention is shown in various stages of assembly in FIGS. 34-36, and is shown assembled in FIG. 37. Two or more of the assembled pallet rails 600 are usable in spaced-apart relation to support a rigid load and to form a pallet with the load. The assembled pallet rail 600 includes an elongate support box 602 and a plurality of separately-formed reinforcing tubes 640, which are shown in FIG. 36 prior to being positioned in the support box 600 to form the reinforced pallet rail shown in FIG. 37.

To form the support box 602, a paper blank 604 is folded along three parallel fold lines 606, 607 and 608 as shown in FIGS. 34-35 to define walls of the support box 602. The support box 602 has two laterally spaced-apart side walls 610 and 612, a bottom wall 614, and a vertically spaced-apart upper support wall 616 for supporting a rigid load. In the illustrated embodiment, the paper blank 602 is folded along a fourth fold line 609 that is parallel to the three fold lines 606-608 to define a second bottom wall 618 (FIG. 35) overlapping the bottom wall 614 as shown in FIG. 36.

The first and second bottom walls 614 and 618 may be fixed into their illustrated overlapping relation by an adhesive such as ethylene vinyl acetate (EVA) glue that is sprayed or spread onto either or both of their mutually contacting surfaces. Other adhesives and mechanical connectors such as staples can also be used. By fixing the first and second bottom walls together, the support box 602 is fixed in its assembled state as shown in FIG. 36.

The upper support wall 616 has multiple openings 620 as shown in FIG. 36, having at least arcuate circular portions, for receiving the reinforcing tubes 640 and retaining the reinforcing tubes 640 in a friction-fit engagement within the support box 602 as shown in FIG. 37. The reinforcing tubes 640 are positioned within the support box 602 in spaced-apart relation along the length of the support box 602 between the bottom wall 614 and upper support wall 616 to reinforce the support box 602 and to define the distance of the upper support wall 616 above the bottom wall 614. This construction enables the pallet rail 600 to withstand heavier loads. The reinforcing tubes can be fixed into their illustrated positions by use of an adhesive such as ethylene vinyl acetate (EVA) glue fixing each to the bottom wall 614. Other adhesives and mechanical connectors such as staples can also be used.

Advantageously, the two sidewalls 610 and 612 have arcuate corners 611 (FIG. 34) and 613 at their longitudinal ends. Thus, the longitudinal ends 603 of the support box 602 have curved lower profiles as shown in FIG. 37. This feature minimizes jamming of the pallet rail 600 as it is moved manually or in an automated environment and, for example, when the pallet rail 600 is slid into position under a load.

The notches 622 defined by the longitudinal ends 603 of the support box 602 represent another advantageous feature of the inventive pallet rail 600. The notches 622 are formed in the longitudinal ends of the upper support wall 616, the bottom wall 614, and the second bottom wall 618, for aligning the pallet rail under corresponding alignment notches of a rigid load or other support member used in conjunction with the pallet rail 600 to define a palletized load. For example, the platform 212 of FIG. 16 has alignment notches 228 by which the pallet rail 600 (FIG. 37) could be aligned with the platform 212 to support the platform in lieu of the leg member 203.

The notches 624 defined by the longitudinal ends 603 of the support box 602 represent another advantageous feature of the inventive pallet rail 600. The notches 622 are formed in the longitudinal ends of the sidewalls 610 and 612 for receiving and holding a wrapping material when the pallet rail 600 is to be wrapped with a load. This feature is particularly advantageous as a wrapping material is pulled manually from a wide roll and wrapping of a palletized load begins.

The paper blank 604 can be made of corrugated paper, or other suitable material including moisture resistant paper board. It should be noted that the term "paper" as used here refers generally to all kinds of paper, including cardboard. The paper blank 604 may be die cut or otherwise prepared from a single planar sample of material or may be assembled from several strips joined, for example along the fold lines illustrated in FIG. 34. The reinforcing tubes 640 may be formed of densified paper. For example, the reinforcing tubes 640 may be formed as laminated layered rolls of paper.

Figure 38:
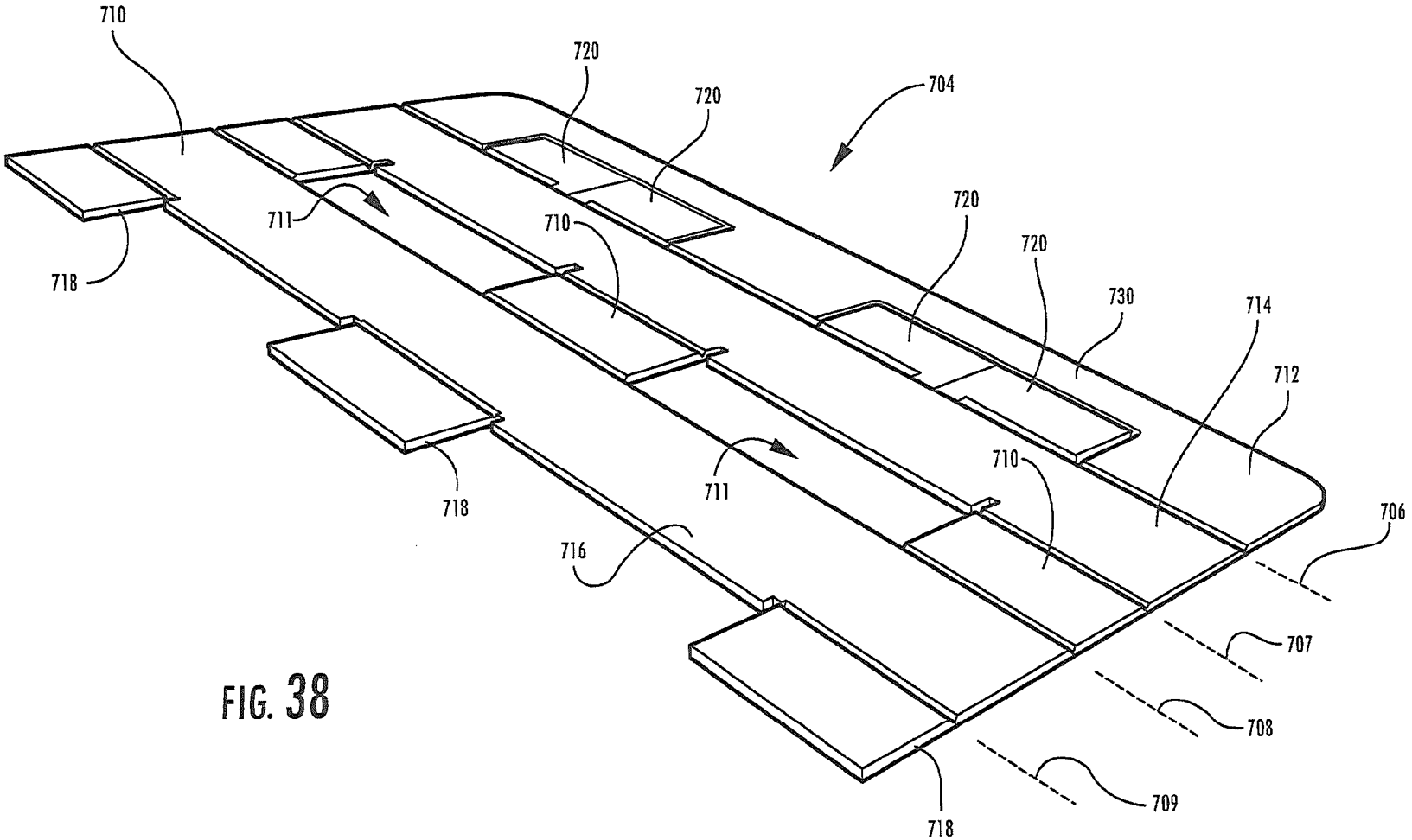
FIG. 38 is a perspective view of a paper blank used to form the pallet rail of FIG. 40.
Figure 39:
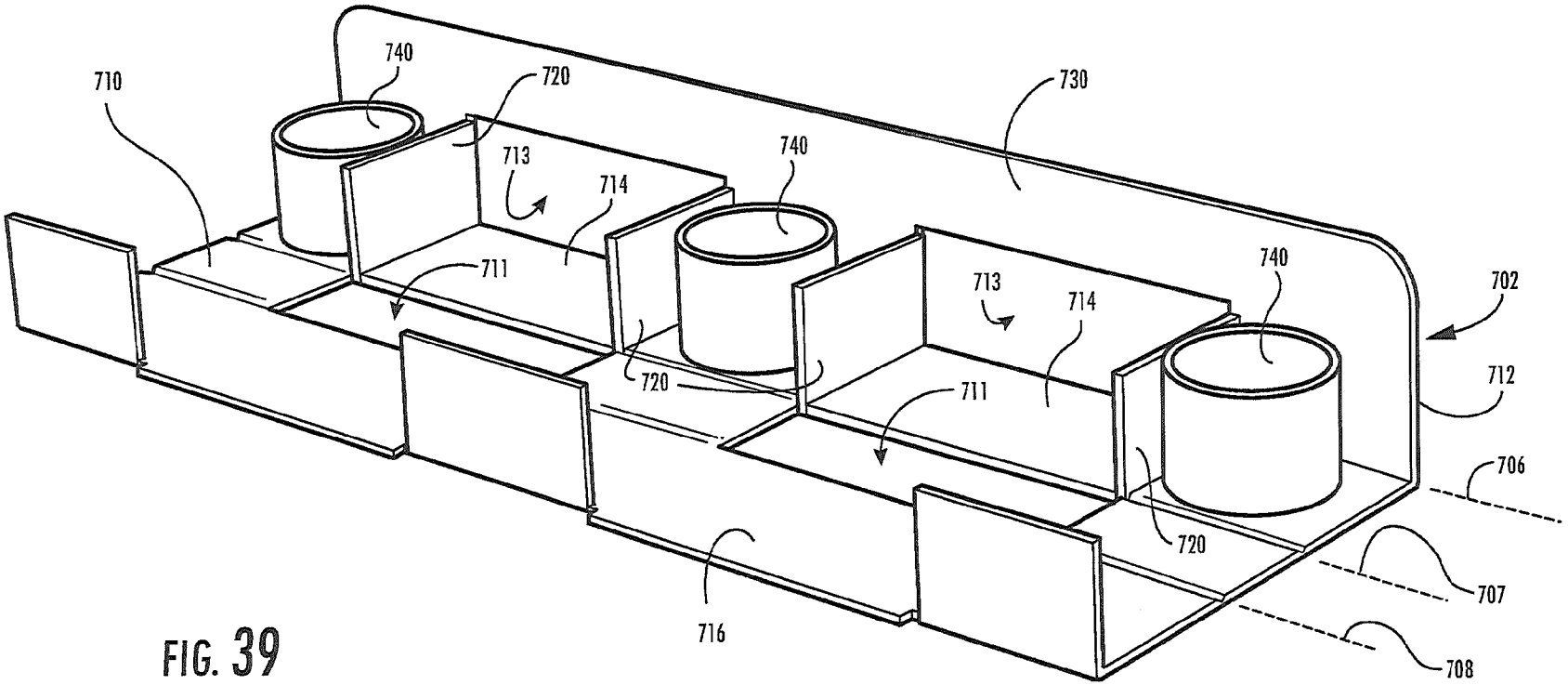
FIG. 39 is a perspective view of the paper blank of FIG. 38 shown folded along several fold lines in a stage of forming the pallet rail of FIG. 40.
Figure 40:
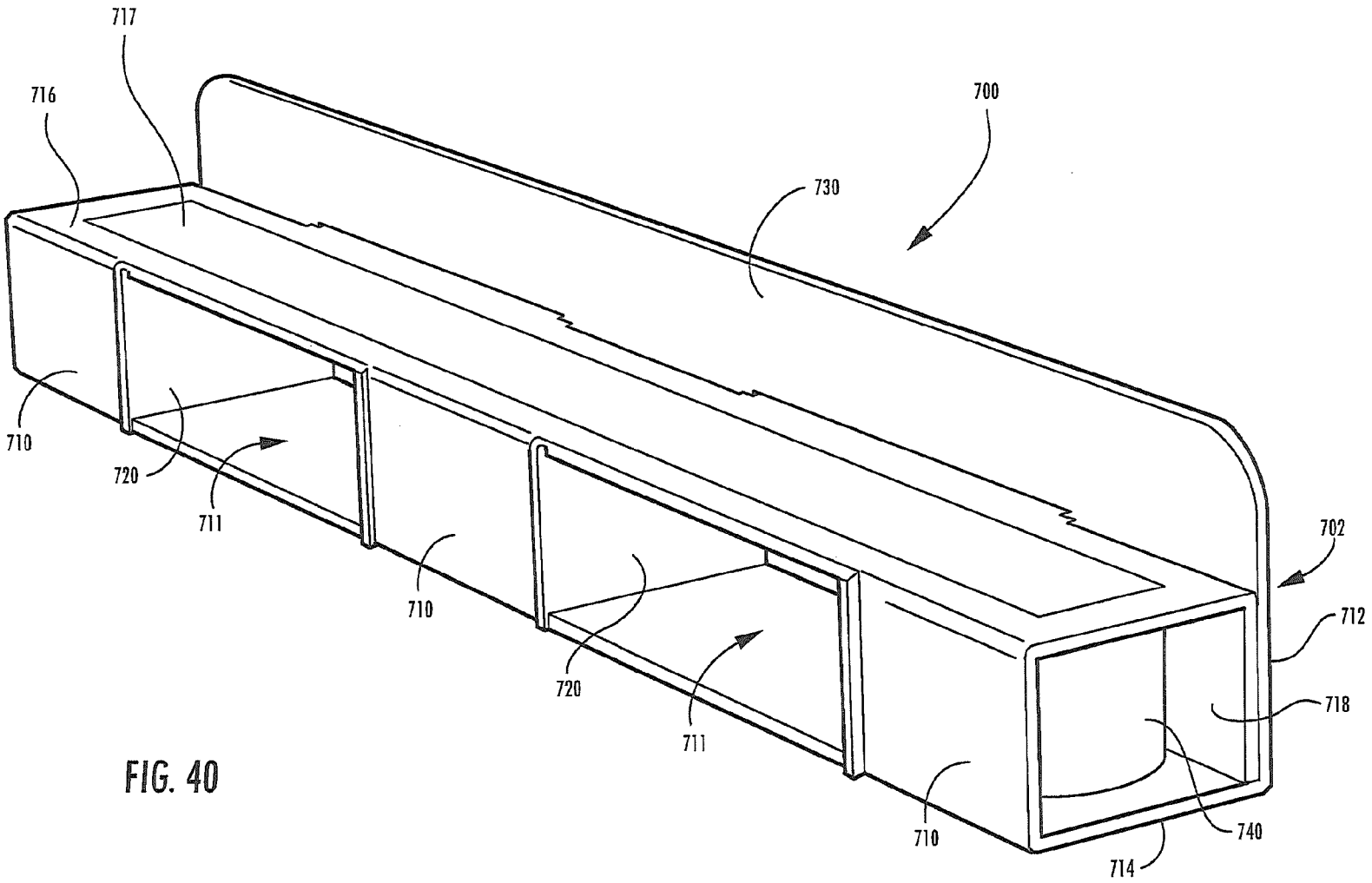
FIG. 40 is a perspective view of a pallet rail, according to a second embodiment of the present invention, having an upwardly projecting end wall for engaging a rigid load.

A pallet rail 700 according to at least one other embodiment of the invention is shown in respective stages of assembly in FIGS. 38-39, and is shown assembled in FIG. 40. Two or more of the assembled pallet rails 700 are usable in spaced-apart relation to support opposing ends of a rigid load and to form a pallet with the load. The assembled pallet rail 700 includes an elongate support box 702 and a plurality of separately-formed reinforcing tubes 740 as shown in FIG. 39.

To form the support box 702, a paper blank 704 is folded along three parallel fold lines 706, 707 and 708 as shown in FIGS. 38-39 to define walls of the support box 702. The support box 702 is shown partially assembled in FIG. 39 with the reinforcing tubes 740 positioned therein. The support box 702 as shown in FIG. 40 has an inner wall 710 and an outer wall 712 laterally spaced-apart from the inner wall 710, a bottom wall 714, and a vertically spaced-apart upper support wall 716 for supporting a rigid load.

Reinforcing tubes 740 are positioned within the support box 702 in spaced-apart relation along the length of the support box 702 between the bottom wall 714 and upper support wall 716 to reinforce the support box 702 and to define the distance of the upper support wall 716 above the bottom wall 714. This construction enables the pallet rail 700 to withstand heavier loads.

At least two openings 711 in the inner wall 710 and at least two openings 713 in the outer wall 712 are aligned for receiving the forks of a forklift so that a palletized load can be lifted and moved by the forklift. In the illustrated embodiment, the pallet rail 700 includes longitudinally spaced apart lateral walls 720 extending between the openings 713 in the outer wall 712 and the openings 711 in the inner wall 710 for facing the forks of the forklift.

Advantageously, as shown in FIG. 40 the pallet rail 700 includes an end wall 730 adjacent the outer wall 712 and projecting upwardly from the outer wall 712 for engaging one end of a rigid load. This feature advantageously facilitates aligning pallet rails 700 along the sides of a load. In the illustrated embodiment of the pallet rail 700, the end wall 730 is a portion of the paper blank 704 that extends integrally upward from the outer wall 712 without fold lines between the end wall 730 and outer wall 712. The end wall 730 guides the pallet rail 700 into alignment with a vertical side of a load as the pallet rail 700 is positioned under the load with the load to be supported by the upper support wall 716. With two pallet rails 700 positioned at opposing ends of a load, with their inner walls 710 facing inward toward the load and toward each other, and with their outer walls 712 position outward from the load, such that the two pallet rails oppose each other in mirror-image relation, the two pallet rails 700 and the load define a palletized load that can be lifted and moved using a forklift or pallet jack by passing the forks thereof through the openings 711 and 713 of the two pallet rails 700.

In the illustrated embodiment of the pallet rail 700, an adhesive strip 717 is positioned along the upper support wall 716 to adhere the pallet rail 700 to the bottom of a load to form a palletize load. The adhesive strip 717 includes a double-sided adhesive layer fixed along its bottom side to the upper support wall and releasably retaining a protective layer along its upper side. The protective layer, which may be a strip of waxed paper for example, is removed to expose the adhesive top side of the double sided adhesive layer to prepare the pallet rail 700 for attachment to a load. The palletized load may also be wrapped with a wrapping material, engaging particularly the end walls 730, to fix the pallet rails into position and to stabilize the load.

Furthermore, in the illustrated embodiment, the paper blank 702 of FIG. 38 includes flaps 718 that are folded along a fourth fold line 709 that is parallel to the three fold lines 706-708 to bring the flaps 718 into overlapping relation with the outer wall 712 as the support box 702 is assembled as shown in FIG. 40. The flaps 718 may be fixed into their illustrated overlapping relation with the outer wall 712 by an adhesive such as ethylene vinyl acetate (EVA) glue. Other adhesives and mechanical connectors such as staples can also be used. By fixing the 718 and the outer wall 712 together, the support box 702 is fixed in its assembled state as shown in FIG. 36.

The paper blank 704 can be made of corrugated paper, or other suitable material including moisture resistant paper board. It should be noted that the term "paper" as used here refers generally to all kinds of paper, including cardboard. The paper blank 704 may be die cut or otherwise prepared from a single planar sample of material or may be assembled from several strips joined, for example along the fold lines illustrated in FIG. 38. The reinforcing tubes 740 of FIG. 39 may be formed of densified paper. For example, the reinforcing tubes 740 may be formed as laminated layered rolls of paper.

Figure 41:
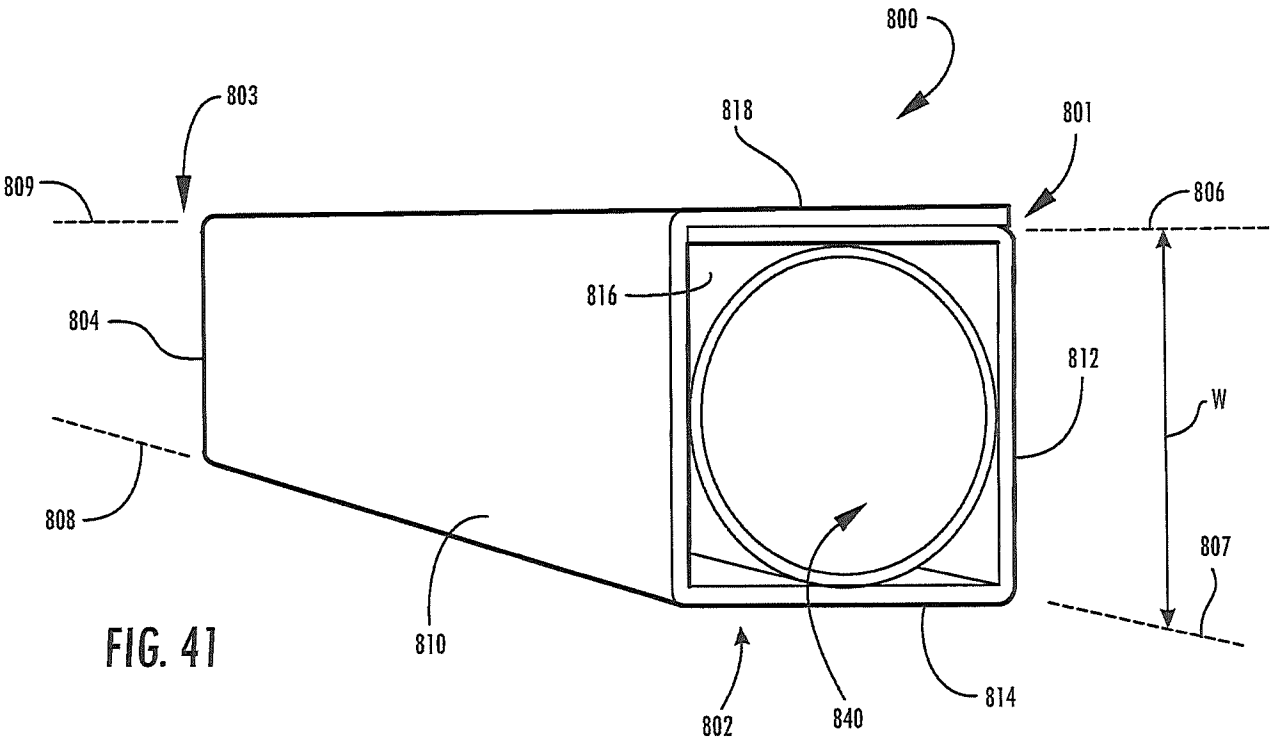
FIG. 41 is a perspective view of a pallet rail, according to a third embodiment of the present invention, having an elongate support box and a longitudinally positioned reinforcing tube therein.

A pallet rail 800 according to at least yet another embodiment of the invention is shown in FIG. 41. Two or more of the assembled pallet rails 800 are usable in spaced-apart relation to support opposing ends of a rigid load and to form a pallet with the load. The pallet rail 800 includes an elongate support box 802 and an elongate reinforcing tube 840. The support box 802 is formed from a paper blank 804 that is folded along three parallel fold lines 806, 807 and 808 to define walls of the support box 802. The support box 802 has two laterally spaced-apart side walls 810 and 812, a bottom wall 814, a vertically spaced-apart upper support wall 816 for supporting a rigid load, and opposing longitudinal ends 801 and 803.

The reinforcing tube 840 is positioned longitudinally within the support box 802 along the length of the support box 802 between the bottom wall 814 and upper support wall 816 to reinforce the support box 802 and to define the distance of the upper support wall 816 above the bottom wall 814. This construction enables the pallet rail 800 to exhibit longitudinal rigidity and to withstand heavier loads, especially when the pallet rail 800 supports a load above an open racking system having spaced beams or when the pallet rail 800 is supported from below at its longitudinal ends 801 and 803. In the illustrated embodiment, the paper blank 804 is folded along a fourth fold line 809 that is parallel to the three fold lines 806-808 to define a second upper support wall 818 overlapping the first upper support wall 816.

The first and second upper support walls 816 and 818 may be fixed into their illustrated overlapping relation by an adhesive such as ethylene vinyl acetate (EVA) glue that is sprayed or spread onto either or both of their mutually contacting surfaces. Other adhesives and mechanical connectors such as staples can also be used. By fixing the first and second upper support walls 816 and 818 together, the support box 802 is fixed in its assembled state as shown in FIG. 41.

In at least one embodiment of a method of making the pallet rail 800, the paper blank 804 is formed into the illustrated square tube 802 having a square cross section with four sides 810, 812, 814 and 816, each having substantially the same width W as measured internally within the square tube 802. The round tube 840, which has a diameter substantially the same as the width of the four sides 810, 812, 814 and 816, is positioned into the square tube 802 to reinforce the square tube 802.

In one example of the method, the round tube 840 is positioned into the square tube 802 by inserting the round tube 840 into the longitudinal end 801 or the longitudinal end 803 of the square tube 802. In another example of the method, the first and second upper support walls 816 and 818 are hinged to open the square tube 802 along the length thereof and the round tube 840 is passed laterally into the square tube 802.

Figure 42:
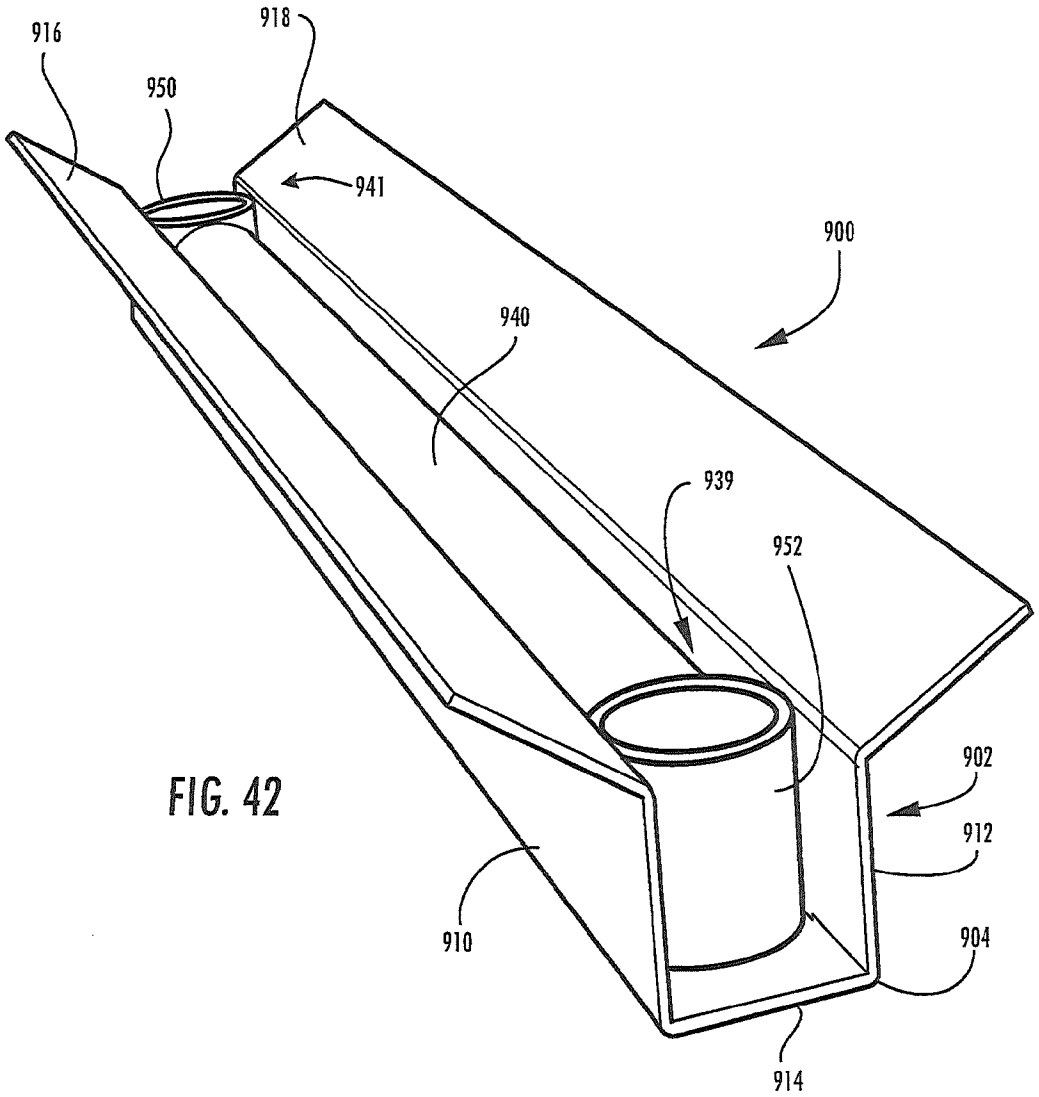
FIG. 42 is a perspective view of another example of a pallet rail, having additional reinforcing tubes within the support box.

In FIG. 41, the round tube 840 has substantially the same length as the square tube 802. In FIG. 42, another embodiment of a pallet rail 900 is shown bearing some similarities to the pallet rail 800 of FIG. 41. For example, the support box 902 is formed by folding of a paper blank 904 to defined two laterally spaced-apart side walls 910 and 912, a bottom wall 914, and two upper support walls 916 and 918 that are shown in hinged open positions. However, in FIG. 42, two separately formed reinforcing tubes 950 and 952 are positioned within the support box 902 at opposing longitudinal ends 939 and 941 of the elongate reinforcing tube 940. The diameter of the reinforcing tube 940, and the lengths of the reinforcing tubes 950 and 952, define the distance between the bottom wall 914 and either of the two upper support walls 916 and 918 once the box is closed by bringing the two upper support walls 916 and 918 into overlapping positions to prepare the pallet rail 900 for use.

The paper blank 804 of FIG. 41 and the paper blank of 904 FIG. 42 can be made of corrugated paper, or other suitable material including moisture resistant paper board, It should be noted that the term "paper" as used here refers generally to all kinds of paper, including cardboard. The paper blanks 804 and 904 may be die cut or otherwise prepared from a single planar sample of material or may be assembled from several strips joined, for example along the folds illustrated in FIGS. 41 and 42. The reinforcing tube 840 of FIG. 41 and reinforcing tubes 940, 950 and 952 of FIG. 42 may be formed of densified paper. For example, the reinforcing tubes 840, 940, 950 and 952 may be formed as laminated layered rolls of paper.

Figures 43A, 43B:
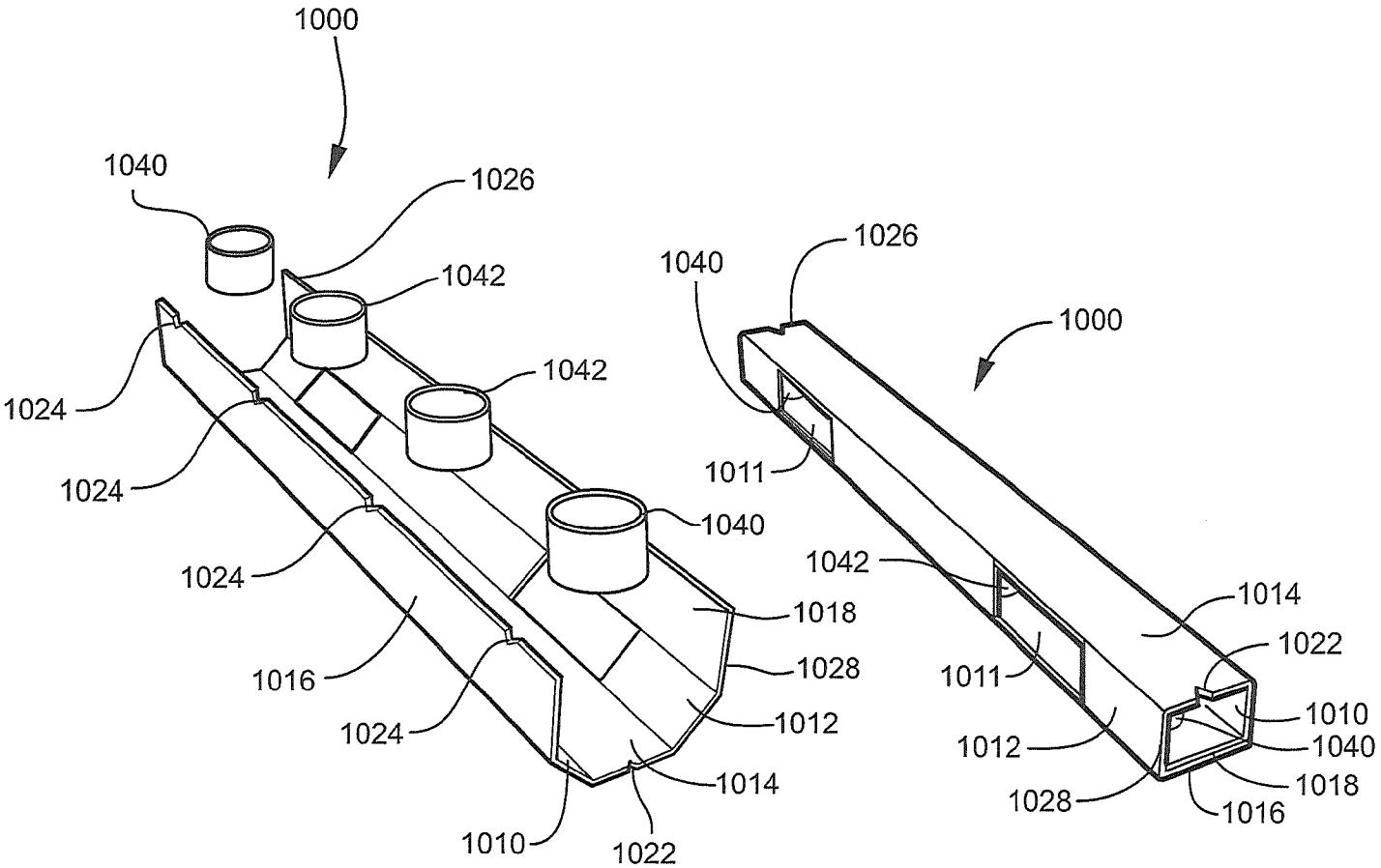
FIG. 43A is an exploded view of a pallet rail having an elongate support box and four reinforcing tubes positioned therein.
FIG. 43B is a perspective view of an assembled pallet rail having four reinforcing tubes poisoned therein.

A pallet rail usable in a four-way pallet according to yet another embodiment of the invention is illustrated in FIGS. 43A and 43B, and shown generally at reference numeral 1000. The pallet rail includes an elongate support box that includes a bottom wall 1016, a second bottom wall 1018, a pair of laterally spaced apart side walls 1010 and 1012, and a vertically spaced-apart upper support wall 1014. The elongate support box includes a pair of die cut, tab-less rectangular openings 1011 that are disposed on the laterally spaced apart side walls 1010. These openings 1011 do not have tabs or flaps or any other fold of the sort extending inward or outward. They are clean, rectangular openings that extend the full height of the side walls. The support box includes a pair of central alignment notches 1022 that align with notches on the rigid load 1050 (see FIG. 44) The alignment notches 1022 are visible from a front, rear, top or bottom view. The pallet rail 1000 also includes a set of either three or four separately-formed reinforcing tubes 1040 and 1042. The tubes 1040 and 1042 are attached to the support box. The pallet rail also includes a set of four notches 1024 for receiving and holding a wrapping material for wrapping the pallet rail with a rigid load 1050. The pallet is reversible such that the rigid load can be applied to the upper support wall 1014 or the bottom support walls 1016 and 1018.

The tubes as shown in FIGS. 43A and 43B include two different positioning. End tubes 1040 are positioned between the rectangular openings 1011 while tubes central tubes 1042 are positioned between one of the rectangular openings 1011 and one longitudinal end 1026 and 1028 of the support box.

Figure 44:
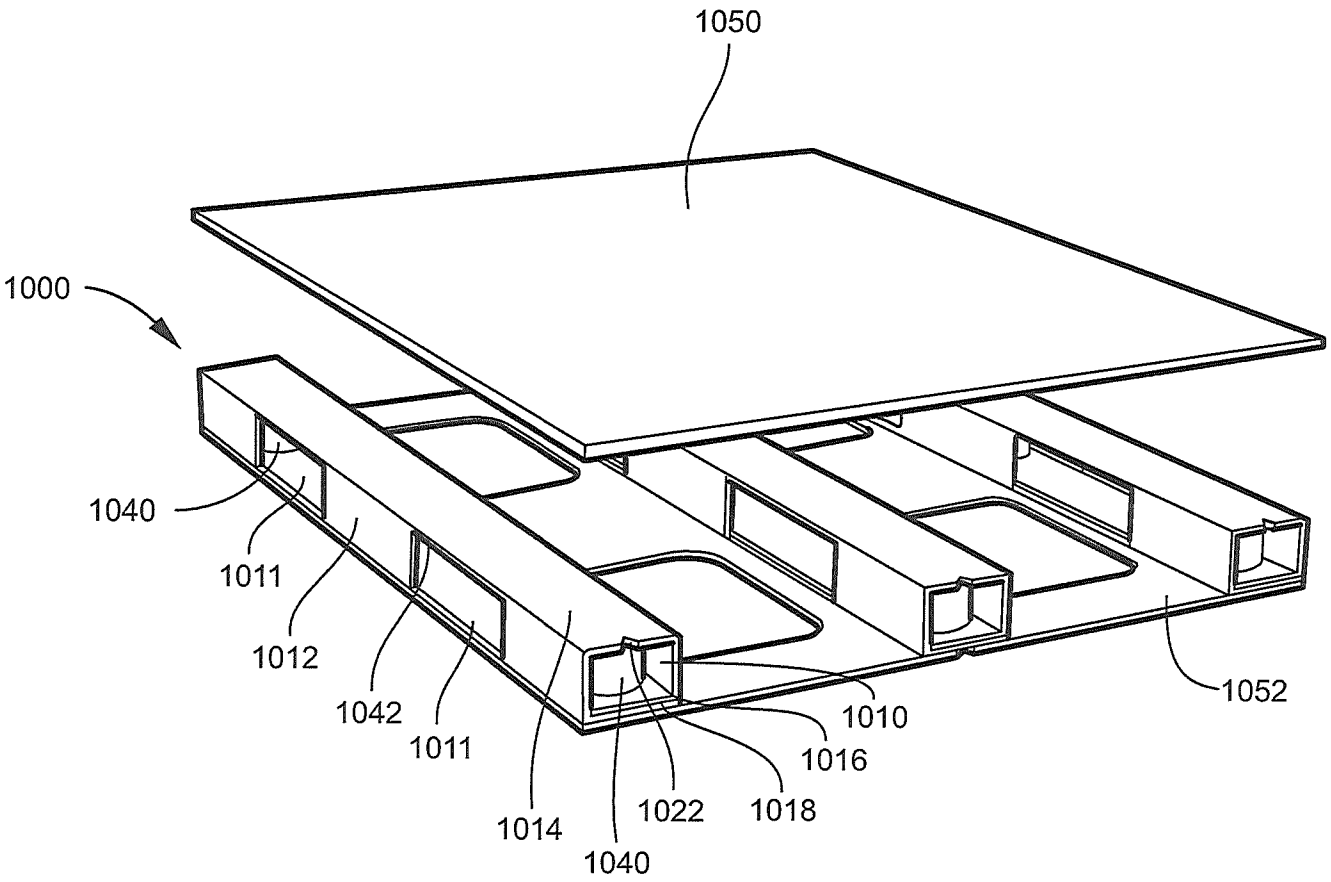
FIG. 44 is a perspective view of a pallet having three pallet rails with each of the rails having a pair of die cut, tab-less rectangular openings for receiving the forks of a forklift.

FIG. 44 shows and embodiment of the invention where a rigid load deck 1050 is attached to three of the rails 1000 as described above. A substantially flat base member 1052 ties the rails together as well. The rigid load deck 1050 and the substantially flat base member 1052 are adhered to the rails via ethylene vinyl acetate.

The foregoing has described a pallets and methods for making the same. While specific embodiments have been described, it will be apparent to those skilled in the art that various modifications thereto can be made without departing from the spirit and scope of these descriptions. Accordingly, the foregoing descriptions of the particular embodiments and the best modes for practicing the embodiments are provided for the purpose of illustration only and not for the purpose of limitation.

I claim:

1. A pallet rail, two or more of which are usable in spaced-apart relation to support respective portions of a rigid load to thereby form a four-way pallet, comprising:

(a) an elongate support box formed from a paper blank that is folded along four parallel fold lines to define a pair of laterally spaced-apart side walls, a bottom wall, a second bottom wall overlapping the bottom wall, and a vertically spaced-apart upper support wall, wherein the bottom wall and the second bottom wall are adhered to each other with an adhesive comprising ethylene vinyl acetate, and wherein the second bottom wall further comprises a set of four notches formed for receiving and holding a wrapping material for wrapping the pallet rail and the rigid load;

(b) a pair of clean, die cut, tab-less, rectangular openings, disposed on each one of the pair of side walls, having a height that is equal to the height of the side wall and a width of sufficient size for a fork of a fork lift to enter;

(c) a first and a second central alignment notch, at least one of the notches visible from a front, or rear view, each of the central alignment notches being aligned with corresponding alignment notches located on the rigid load, wherein the first central alignment notch is disposed on a longitudinal end of the upper support wall and the second central alignment notch is disposed on an opposite longitudinal end of the upper support wall;

(d) a set of no more than four separately-formed reinforcing tubes, comprising densified paper, positioned within the support box, being cylindrical around an axis that is perpendicular to the upper support wall, and further comprising (i) a first end tube positioned midway between a plane formed by the outer edges of two of the clean, die cut, tab-less, rectangular openings disposed on opposite side walls and the plane formed by the outer edges of the end of the support box, (ii) a second tube positioned midway between a plane formed by the outer edges of the other two of the clean, die cut, tab-less, rectangular openings disposed on opposite side walls and the plane formed by the outer edges of the other end of the support box, and (iii) one or two central tubes positioned between the plane formed by the inner edges of the two clean, die cut, tab-less, rectangular openings disposed on opposite side walls and plane formed by the inner edges of the other of the two clean, die cut, tab-less, rectangular openings disposed on opposite side walls.

2. A pallet rail according to claim 1, further comprising an adhesive strip positioned along the upper support wall for adhering the pallet rail to the rigid load.

3. A pallet rail according to claim 2 wherein at least one notch formed for receiving and holding a wrapping material for wrapping the pallet rail and rigid load is disposed on each of the longitudinal ends of the upper support wall.

4. A pallet rail according to claim 1 wherein the paper blank comprises corrugated paper.

5. A pallet rail according to claim 4 wherein the reinforcing tubes and the paper blank are treated to be moisture resistant.

* * * * *